US009457580B2

(12) United States Patent
Kato

(10) Patent No.: US 9,457,580 B2
(45) Date of Patent: Oct. 4, 2016

(54) PRINT DEVICE

(71) Applicant: BROTHER KOGYO KABUSHIKI KAISHA, Nagoya-shi, Aichi (JP)

(72) Inventor: Yoshinori Kato, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 15/016,703

(22) Filed: Feb. 5, 2016

(65) Prior Publication Data

US 2016/0243838 A1 Aug. 25, 2016

(30) Foreign Application Priority Data

Feb. 20, 2015 (JP) ..... 2015-031620

(51) Int. Cl.
*B41J 2/175* (2006.01)
*B41J 2/18* (2006.01)

(52) U.S. Cl.
CPC ..... *B41J 2/175* (2013.01); *B41J 2/1752* (2013.01); *B41J 2/17523* (2013.01)

(58) Field of Classification Search
CPC .. B41J 2/175; B41J 2/17506; B41J 2/17509; B41J 2/1752; B41J 2/17523; B41J 2/17596; B41J 2/18; B41J 2/185
See application file for complete search history.

(56) References Cited

U.S. PATENT DOCUMENTS 5,880,748 A * 3/1999 Childers ..... B41J 2/175 347/6
6,264,318 B1 * 7/2001 Oda ..... B41J 2/175 347/86
6,517,189 B2 * 2/2003 Ogawa ..... B41J 2/16532 347/29
6,840,604 B2 * 1/2005 Kimura ..... B41J 2/175 347/85
7,150,519 B2 * 12/2006 Kono ..... B41J 2/175 347/30
8,485,620 B2 * 7/2013 Kitabatake ..... B41J 2/17509 347/6

FOREIGN PATENT DOCUMENTS

JP 2004-167839 A 6/2004

* cited by examiner

*Primary Examiner* — Anh T. N. Vo
(74) *Attorney, Agent, or Firm* — Fox Rothschild LLP

(57) ABSTRACT

A print device includes a mount portion, a lead-out needle, a head, liquid passages, a branch portion, and first resistance portions. The lead-out needle is provided on the mount portion and connected to a storage portion such that the liquid can be led out from the storage portion when the storage portion is mounted on the mount portion. The head has ejection areas capable of ejecting the liquid. Each of the liquid passages is connected to a corresponding one of the ejection areas and feeds the liquid from the storage portion. The branch portion causes the liquid led out from the lead-out needle to branch into each of the liquid passages. Each of the first resistance portions located between the branch portion and the head is provided corresponding to one of the liquid passages and generates a larger flow resistance than the lead-out needle.

13 Claims, 13 Drawing Sheets

PRINT DEVICE

CROSS-REFERENCE TO RELATED APPLICATION

This application claims priority to Japanese Patent Application No. 2015-031620 filed on Feb. 20, 2015, the disclosure of which is herein incorporated by reference in its entirety.

BACKGROUND

The present disclosure relates to a print device.

An inkjet printer is known that can remove foreign matter contained in ink by having a filter inserted into a feed path that feeds the ink to an inkjet head.

SUMMARY

In order to feed a liquid (ink, for example) from a storage portion (an ink cartridge, for example) to a plurality of liquid feed destinations, sometimes a plurality of liquid passages are provided that are connected to the storage portion. In a case in which lengths and diameters of the liquid passages are approximately equal to each other, depending on an arrangement of resistance portions, such as filters or the like, it becomes easy for variations to occur in a flow resistance in each of the liquid passages. For example, there is a case in which a flow resistance occurring in liquid flowing back and forth between the plurality of liquid passages is smaller than a flow resistance occurring in the liquid being supplied to each of the plurality of liquid passages from the storage portion. In this case, in the feeding of the liquid to the plurality of liquid passages, liquid is easily pulled from some of the liquid passages to others of the liquid passages. As a result, there may be insufficient feed of the liquid from the storage portion to some of the liquid passages, and there may be a deterioration in the print quality of a print device.

Various embodiments of the general principles described herein provide a print device that is capable of reducing a possibility of a deterioration occurring in print quality, as a result of a feed failure of a liquid in each of a plurality of liquid passages.

Embodiments herein provide a print device including a mount portion, a lead-out needle, a head, liquid passages, a branch portion, and first resistance portions. The mount portion is configured to allow a storage portion storing a liquid to be mounted thereon. The lead-out needle is provided on the mount portion. The lead-out needle is connected to the storage portion in a manner that the liquid can be led out from the storage portion when the storage portion is mounted on the mount portion. The head is provided with ejection areas each being capable of ejecting the liquid. Each of the liquid passages is connected to a corresponding one of the ejection areas, and is provided to feed the liquid from the storage portion. The branch portion is provided to cause the liquid led out from the lead-out needle to branch into each of the liquid passages. Each of the first resistance portions is located between the branch portion and the head and is provided corresponding to one of the liquid passages. Each of the first resistance portions is configured to generate a flow resistance larger than a flow resistance of the liquid in the lead-out needle.

BRIEF DESCRIPTION OF THE DRAWINGS

Embodiments will be described below in detail with reference to the accompanying drawings in which.

DETAILED DESCRIPTION

A schematic configuration of a printer 1 will be explained with reference to FIG. 1 to FIG. 6. The upper side, the lower side, the lower left side, the upper right side, the lower right side and the upper left side in FIG. 1 respectively correspond to the upper side, the lower side, the front side, the rear side, the right side and the left side of the printer 1.

Figure 1:
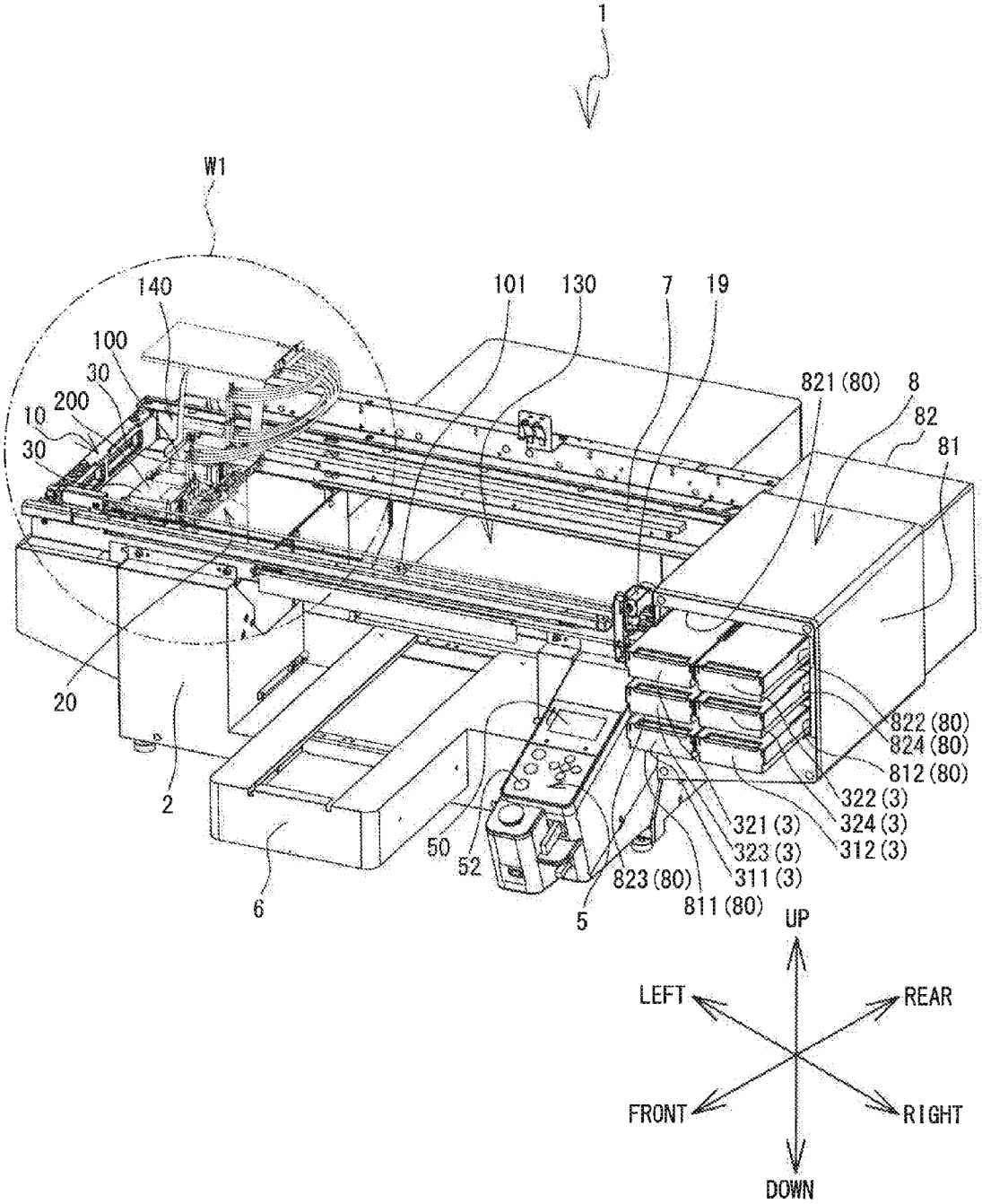
FIG. 1 is a perspective view of a printer.

As shown in FIG. 1, the printer 1 is an inkjet printer that performs printing by ejecting a liquid ink 97 (refer to FIG. 12) onto a print medium (not shown in the drawings). The print medium of the printer 1 is a cloth, particularly a T-shirt, for example. Paper or the like may be used as the print medium of the printer 1. In the present embodiment, the printer 1 can perform printing of a color image on the print medium by ejecting five types of mutually different-colored inks (white (W), black (K), yellow (Y), cyan (C), and magenta (M)) in a downward direction. In the following explanation, of the five types of ink, the white ink 97 is referred to as white ink, and the four colors of the black, cyan, yellow and magenta inks 97 are referred to collectively as color inks. Further, when the white ink and the color inks are collectively referred to, or when one of the inks is not specified, the inks are simply referred to as the ink 97.

The white ink is mainly ejected onto a whole or a part of an area on which the printing is performed, as an undercoat for the printing, such as when a color of the print medium is a dark color. The color inks are mainly used to print the color image on the print medium after the white ink has been ejected. The white ink used in the printer 1 is a liquid including a component having a higher settleability than a component included in the color inks. The component having the high settleability is titanium oxide, for example. The titanium oxide is an inorganic pigment having a relatively high specific gravity. In the white ink that includes the component having the high settleability, pigment particles are likely to be deposited. As a result, when the printing is performed by the printer 1 using the white ink, it is necessary to maintain favorable fluidity of the white ink in the white ink passages, by causing the white ink to be in a sufficiently agitated state.

Figure 2:
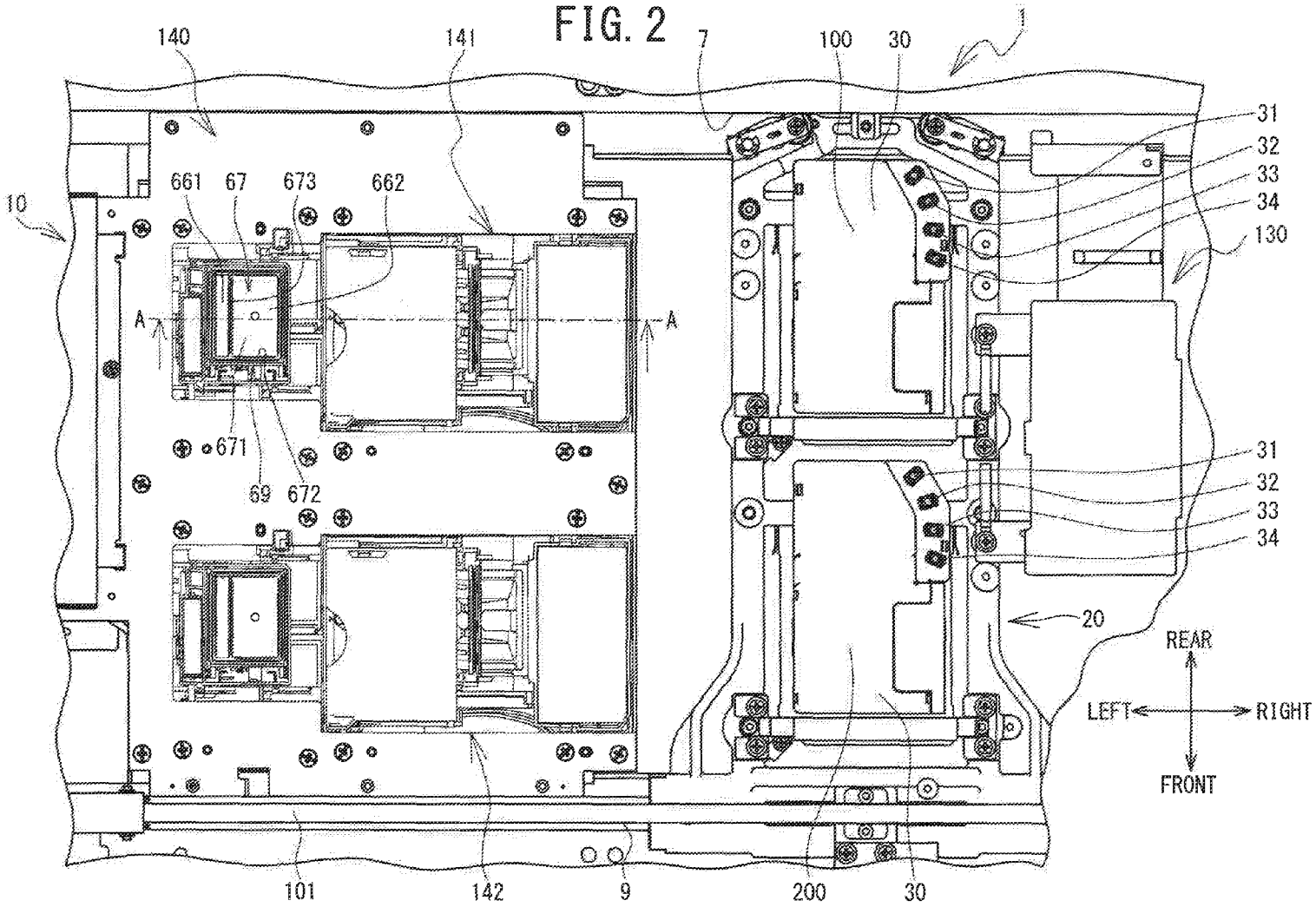
FIG. 2 is a plan view of the printer.
Figure 3:
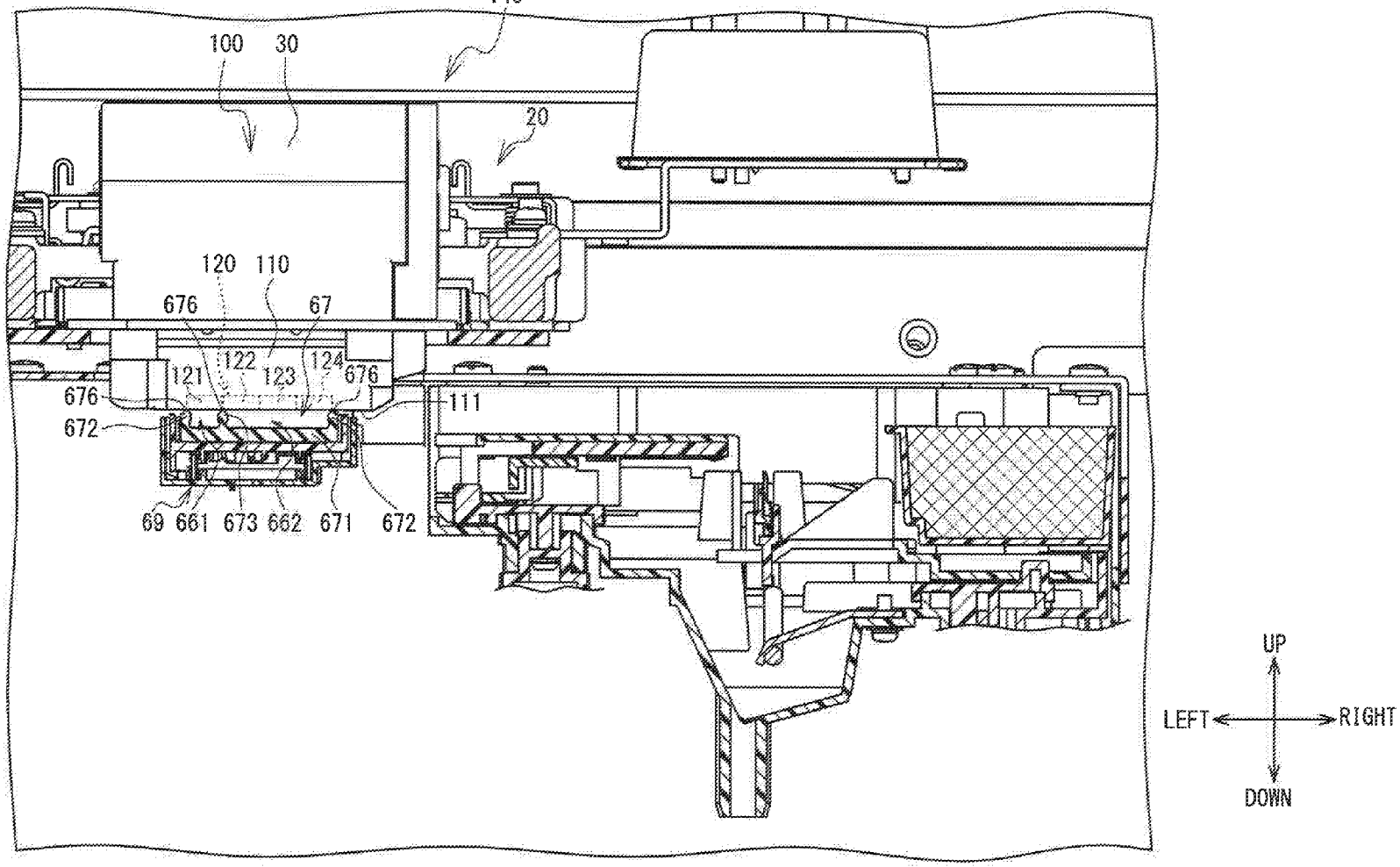
FIG. 3 is a cross-sectional view of a head unit along A-A shown in FIG. 2.

As shown in FIG. 1 to FIG. 3, the printer 1 is mainly provided with a housing 2, a frame body 10, a guide shaft 9, a rail 7, a carriage 20, head units 100 and 200, a drive belt 101, a drive motor 19, a platen drive mechanism 6, a mount frame portion 8, and maintenance portions 141 and 142 of a non-print area 140 that will be described later. In FIG. 2 and FIG. 3, in order to explain each portion, connection units 40 and 51 that will be described later (refer to FIG. 6) are not illustrated.

The housing 2 has a substantially cuboid shape that is long in the left-right direction. An operation portion 5 for performing operations of the printer 1 is provided in a position on the front right side of the housing 2. The operation portion 5 is provided with a display 50 and operation buttons 52. The display 50 displays various types of information. The operation buttons 52 are operated when an operator inputs commands relating to various types of operation of the printer 1.

The frame body 10 has a substantially rectangular frame shape in a plan view, and is installed on an upper portion of the housing 2. The frame body 10 supports the guide shaft 9 (refer to FIG. 2) on the front side of the frame body 10 and supports the rail 7 on the rear side of the frame body 10. The guide shaft 9 is a shaft member that is provided with a shaft-shaped portion that extends in the left-right direction on the inside of the frame body 10. The rail 7 is a rod like member that is provided facing the guide shaft 9 and that extends in the left-right direction.

Figure 4:
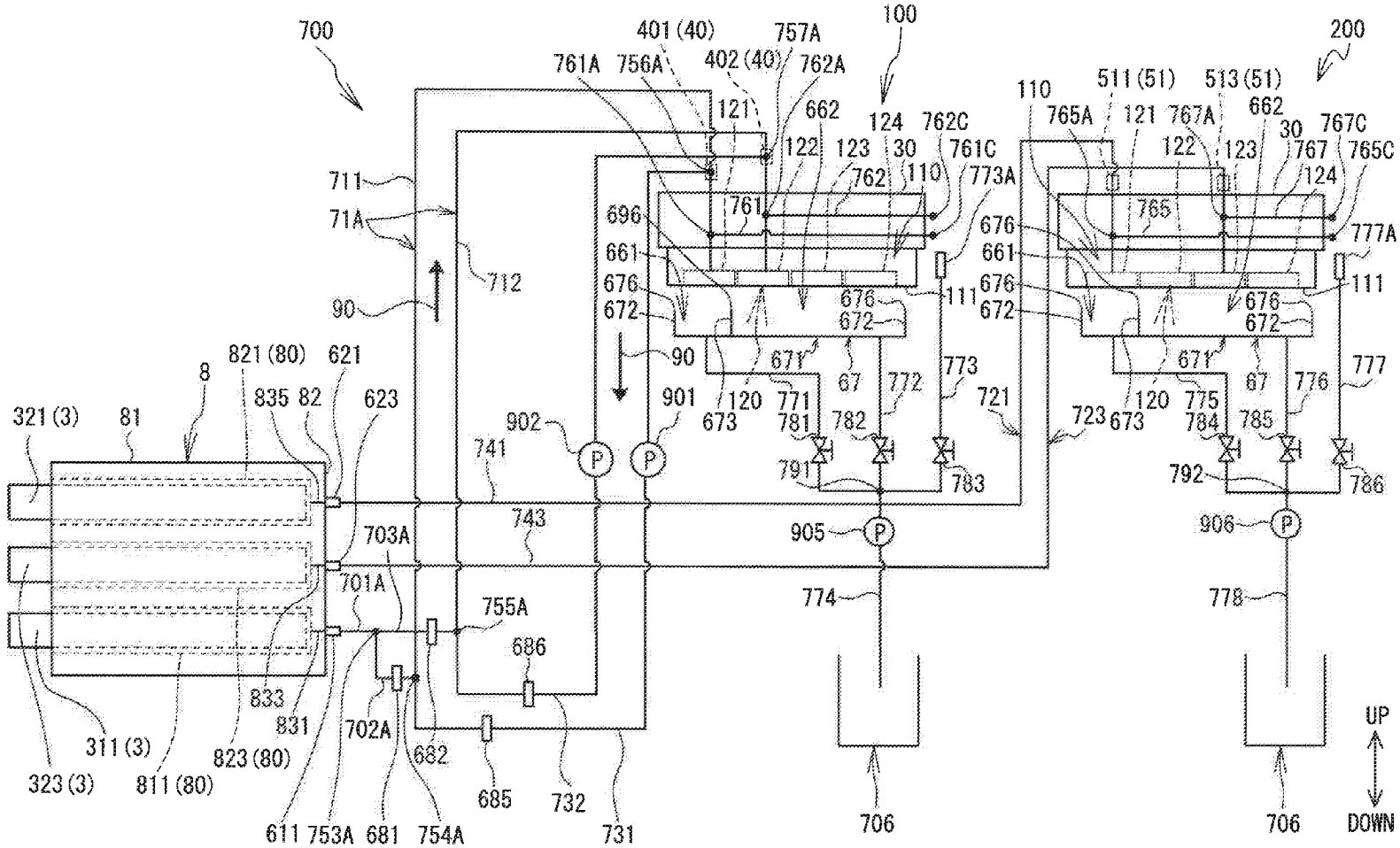
FIG. 4 is a schematic diagram showing a part of an ink passage system.
Figure 5:
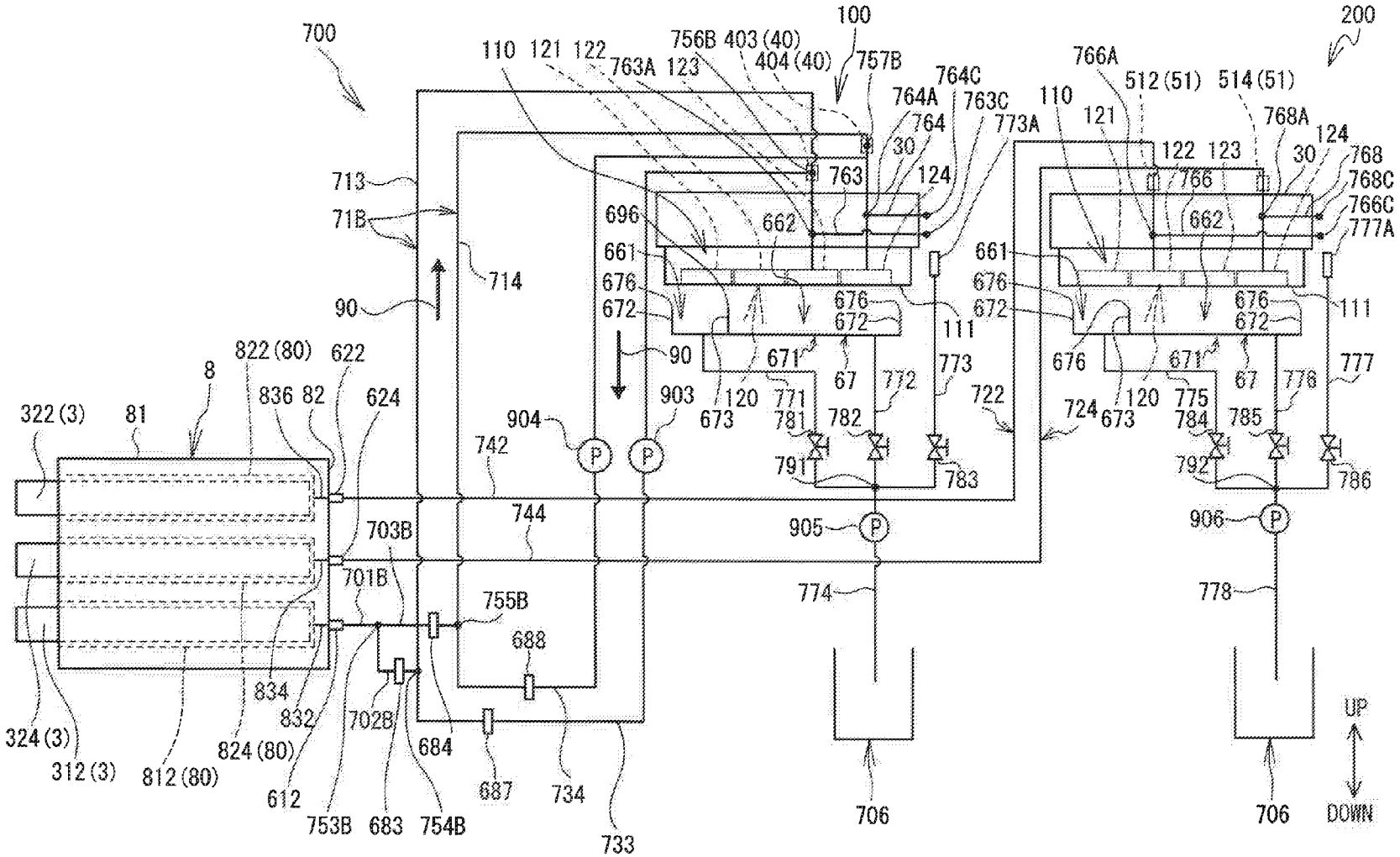
FIG. 5 is schematic diagram showing another part of the ink passage system.

The carriage 20 is supported such that it can be conveyed in the left-right direction along the guide shaft 9. As shown in FIG. 1 and FIG. 2, the head units 100 and 200 are mounted on the carriage 20 such that they are aligned in the front-rear direction. The head unit 100 is positioned further to the rear than the head unit 200. As shown in FIG. 1 to FIG. 3, the head units 100 and 200 are provided with housings 30, which are substantially box shaped support bodies. As shown in FIG. 3, a lower portion of the housing 30 of the head unit 100 supports a head portion 110, which can eject the ink 97 toward the print medium. A lower portion of the head unit 200 is also configured in a similar manner to the head unit 100. FIG. 4 and FIG. 5 are schematic diagrams illustrating positions in the up-down direction of each of members configuring passages of the ink 97 inside the printer 1. Therefore, in FIG. 4 and FIG. 5, the head units 100 and 200 are shown aligned to the left and the right on the page, as seen from the front side. The head portion 110 of the head unit 100 ejects the white ink. The head portion 110 of the head unit 200 ejects the color inks.

The head portion 110 is provided with a nozzle surface 111 (refer to FIG. 3), which is a surface that has a plurality of fine nozzles 113 (refer to FIG. 12) that can eject the ink 97 downward. The nozzle surface 111 is a flat surface that is parallel to a horizontal plane, and is formed on a bottom surface of each of the head units 100 and 200. On the nozzle surface 111, the plurality of nozzles 113 are provided in a nozzle arrangement area 120. The nozzle arrangement area 120 is provided in a center portion of the nozzle surface 111 in the left-right direction, and extends in the front-rear direction.

The nozzle surface 111 has nozzle arrangements 121 to 124. Each of the nozzle arrangements 121 to 124 is an array of the plurality of nozzles 113, and is located in one of four areas of the nozzle arrangement area 120, which is divided into four in the left-right direction. The nozzle arrangements 121 to 124 are arranged from the left to the right in the order of the nozzle arrangement 121, the nozzle arrangement 122, the nozzle arrangement 123 and the nozzle arrangement 124.

As shown in FIG. 4 and FIG. 5, the nozzle arrangements 121 to 124 of the head unit 100 are nozzle arrangements that can each eject the white ink. Respectively, the nozzle arrangements 121 and 122 of the head unit 100 are connected to a single cartridge 311 (refer to FIG. 1 and FIG. 4) that stores the white ink, and the nozzle arrangements 123 and 124 of the head unit 100 are connected to another single cartridge 312 (refer to FIG. 1 and FIG. 5) that stores the white ink.

The nozzle arrangements 121 to 124 of the head unit 200 can be connected to cartridges 321 to 324 that store the color inks. In the head unit 200, the nozzle arrangement 121 is connected to the cartridge 321 (refer to FIG. 1 and FIG. 4) that stores the black ink, the nozzle arrangement 122 is connected to the cartridge 322 (refer to FIG. 1 and FIG. 5) that stores the yellow ink, the nozzle arrangement 123 is connected to the cartridge 323 (refer to FIG. 1 and FIG. 4) that stores the cyan ink, and the nozzle arrangement 124 is connected to the cartridge 324 (refer to FIG. 1 and FIG. 5) that stores the magenta ink, respectively.

As shown in FIG. 1, the drive belt 101 is band-shaped, and is stretched along the left-right direction on the inside of the frame body 10. The drive belt 101 is made of a flexible synthetic resin. The drive motor 19 is provided on a front right portion on the inside of the frame body 10. The drive motor 19 can rotate in the forward direction and the reverse direction, and is coupled to the carriage 20 via the drive belt 101. When the drive motor 19 drives the drive belt 101, the carriage 20 is caused to reciprocate in the left-right direction along the guide shaft 9. As a result, the head units 100 and 200 are caused to reciprocate in the left-right direction (a scanning direction), and the head units 100 and 200 eject the ink 97 toward a platen (not shown in the drawings) that is provided below the head units 100 and 200 such that it faces the head units 100 and 200. In this way, printing is performed on the print medium supported by the platen.

The platen drive mechanism 6 is provided with a pair of guide rails (not shown in the drawings) and the platen (not shown in the drawings). The pair of guide rails extend in the front-rear direction on the inside of the platen drive mechanism 6, and support the platen such that the platen can move along the pair of guide rails in the front-rear direction of the housing 2. The platen is a plate that has a substantially rectangular shape in a plan view, is long in the front-rear direction of the housing 2, and is provided below the frame body 10. An upper portion of the platen holds the print medium (the T-shirt or the like) that is made from cloth, for example. The platen drive mechanism 6 is driven by a motor (not shown in the drawings) provided in a rear end portion of the printer 1, and moves the platen in the front-rear direction, thus conveying the print medium in the front-rear direction (a sub-scanning direction). The ink 97 is ejected from the head portions 110 that are reciprocating in the left-right direction. In this manner, the printing is performed on the print medium by the printer 1.

As shown in FIG. 1, the mount frame portion 8 is provided on the right side of the housing 2. The mount frame portion 8 is supported by a housing 81 that has a substantially cuboid shape and is long in the front-rear direction. A plurality of cartridges 3 can be mounted in the mount frame portion 8, which is provided, specifically, with a plurality of mount portions 80. The plurality of mount portions 80 are recessed portions that are recessed toward the rear in a square shape from the front of the mount frame portion 8. Lead-out needles 831 to 836 (refer to FIG. 4 and FIG. 5) are respectively provided in a rear portion on the inside of each of the plurality of mount portions 80. The lead-out needles 831 to 836 are hollow needle shapes. When the cartridges 3 are mounted in the mount portions 80, the lead-out needles 831 to 836 pierce rubber plugs (not shown in the drawings) provided on ink storage bodies (not shown in the drawings) housed inside the cartridges 3. The lead-out needles 831 to 836 lead out the ink 97 from the ink storage bodies housed in the cartridges 3. The ink 97 that has been led out by the lead-out needles 831 to 836 is supplied to the head portions 110.

The plurality of mount portions 80 are arrayed in two rows in the left-right direction and in three rows in the up-down direction. As shown in FIG. 1, FIG. 4, and FIG. 5, the plurality of mount portions 80 include upper mount portions 821 to 824 that are positioned in an upper portion of the mount frame portion 8, and lower mount portions 811 and 812 that are positioned below the upper mount portions 821 to 824 in the housing 81. The lower mount portion 811 is provided in a lower left portion of the mount frame portion 8, and the lower mount portion 812 is provided to the right of the lower mount portion 811. The upper mount portions 823 and 824 are provided above the lower mount portions 811 and 812, respectively. The upper mount portions 821 and 822 are provided above the upper mount portions 823 and 824, respectively.

The cartridges 311 and 312 that store the white ink can be mounted in the lower mount portions 811 and 812, respectively. The cartridges 321 to 324 that store the color inks can be mounted in the upper mount portions 821 to 824, respectively.

As shown in FIG. 1 and FIG. 2, in the present embodiment, the carriage 20 is provided on the inside of the frame body 10. The head units 100 and 200 move in the left-right direction between a left end portion and a right end portion on the inside of the frame body 10. On movement paths of the head units 100 and 200, an area in which printing is performed by the head units 100 and 200 is referred to as a print area 130. An area on the movement paths of the head units 100 and 200 other than the printing area 130 is referred to as a non-print area 140. The non-print area 140 is an area of a left end portion of the printer 1. The print area 130 is an area from the right side of the non-print area 140 to a right end portion of the printer 1. The platen is provided below the movement paths of the head units 100 and 200 in the print area 130.

As shown in FIG. 2, the maintenance portions 141 and 142 are respectively provided below the movement paths of the head units 100 and 200 in the non-print area 140. Maintenance operations, such as a purge etc., are performed by the maintenance portions 141 and 142 in order to restore an ink ejection performance of the head units 100 and 200 and secure the print quality of the printer 1. The purge is an operation to discharge the ink 97 containing foreign matter, a bubble or the like from the head portions 110 etc. of the head units 100 and 200. The purge includes a suction purge and an exhaust purge. The suction purge is an operation to forcibly discharge the ink 97 containing foreign matter, a bubble or the like from the nozzles 113 by applying a negative pressure to the head portions 110 from the outside. The exhaust purge is an operation to discharge the ink 97 containing foreign matter, a bubble or the like from ink passages further to an upstream side than the head portions 110. By performing these purges, the printer 1 can reduce a possibility of an ejection failure of the ink 97 occurring in the head portions 110.

As shown in FIG. 2 and FIG. 3, the maintenance portion 141 is provided with a cap 67 and the like. The cap 67 is a component used in the purge, and is provided on a left portion of the maintenance portion 141. The cap 67 is made of a synthetic resin, such as silicon rubber, for example, and is provided with a bottom wall 671, a peripheral wall 672 and a partition wall 673. The cap 67 is provided on the inside of a cap support portion 69 that supports the cap 67. The cap support portion 69 is a box shape that is rectangular in a plan view, and is open on the top side. The bottom wall 671 is a plate-shaped wall portion that forms a lower portion of the cap 67 and that extends in the horizontal direction. The bottom wall 671 has a rectangular shape that corresponds to an inner surface of the cap support portion 69 in a plan view. The peripheral wall 672 is a wall portion that is provided on an upper side (the nozzle surface 111 side) of the cap 67, and extends upward from around the periphery of the bottom wall 671. In the up-down direction, the peripheral wall 672 faces the periphery of the nozzle arrangement area 120 of the nozzle surface 111.

The partition wall 673 is a wall portion that is provided on the upper side (the nozzle surface 111 side) of the cap 67, and extends upward from the bottom wall 671. The partition wall 673 is provided between the center of the bottom wall 671 in the left-right direction and the left end portion of the bottom wall 671, and extends in the front-rear direction. The front end and the rear end of the partition wall 673 are respectively connected to the peripheral wall 672. In the up-down direction, the partition wall 673 faces a boundary between the nozzle arrangement 121 and the nozzle arrangements 122 to 124. Cap lips 676 that form the top ends of the peripheral wall 672 and of the partition wall 673 are formed such that they have the same height from the bottom wall 671 in the up-down direction, and are located above the top end of the cap support portion 69.

By providing the partition wall 673, an area inside the peripheral wall 672 is divided into two. In the following explanation, of the areas inside the peripheral wall 672, an area on the left side of the partition wall 673 is referred to as a first area 661 and an area on the right side of the partition wall 673 is referred to as a second area 662.

Due to the drive of a motor and gears and the like (not shown in the drawings), the cap support portion 69 moves in the up-down direction. The cap 67 moves up and down integrally with the cap support portion 69. As shown in FIG. 3, the cap 67 that has moved upward is in close contact with the nozzle surface 111 of the head unit 100 that has moved to the non-print area 140. At this time, the cap lip 676 of the peripheral wall 672 is in close contact with the periphery of the nozzle arrangement area 120 of the nozzle surface 111, and the cap 67 covers the plurality of nozzles 113 of the nozzle surface 111. Further, the cap lip 676 of the partition wall 673 is in close contact with the boundary between the nozzle arrangement 121 and the nozzle arrangements 122 to 124. In the following explanation, a position of the cap 67 and the cap support portion 69 when the cap 67 is in close contact with the nozzle surface 111 is referred to as a cover position. Further, a position of the cap 67 and the cap support portion 69 when the cap 67 is not in close contact with the nozzle surface 111 is referred to as a cap separation position. The purge is performed when the cap 67 and the cap support portion 69 are in the cover position.

An ink passage system 700 of the printer 1 will be explained with reference to FIG. 4 and FIG. 5. In FIG. 4 and FIG. 5, in order to make the drawing easier to understand, the ink passage system 700, the head portions 110 and the caps 67 are schematically illustrated. As shown in FIG. 4 and FIG. 5, the ink passage system 700 is provided with first passages 71A and 71B, and second passages 721 to 724. Note that, in FIG. 4, the passages connected to the lower mount portion 811 of the left column, and to the upper mount portions 821 and 823 (refer to FIG. 1) of the plurality of mount portions 80 are shown. In FIG. 5, the passages connected to the lower mount portion 812 of the right column and the upper mount portions 822 and 824 (refer to FIG. 1) of the plurality of mount portions 80 are shown.

The first passages 71A and 71B are the passages that respectively connect the lower mount portions 811 and 812 to the head portion 110 of the head unit 100. The first passages 71A and 71B are passages along which the white ink flows. The second passages 721 to 724 are passages that respectively connect the upper mount portions 821 to 824 to the head portion 110 of the head unit 200. The second passages 721 to 724 are passages along which the color inks flow.

The first passage 71A will be explained. As shown in FIG. 4, the first passage 71A is provided with the lead-out needle 831, an ink feed port 611, a lead-out passage 701A, connection passages 702A and 703A, a branch portion 753A, connection portions 754A and 755A, first feed passages 711 and 712, circulation passages 731 and 732, connection portions 761A and 762A, discharge passages 761 and 762, discharge ports 761C and 762C, filter portions 681, 682, 685 and 686, and pumps 901 and 902. In the printer 1, the lead-out passage 701A, the connection passages 702A and 703A, the first feed passages 711 and 712, and the circulation passages 731 and 732 are respectively configured from flexible tubes.

The lead-out needle 831 is provided from a rear end inside the lower mount portion 811 toward the front. The ink feed port 611 is provided to the rear of the lower mount portion 811, in a rear surface 82 of the mount frame portion 8. The ink feed port 611 is connected to the lead-out needle 831. The ink feed port 611 feeds the white ink led out from the lower mount portion 811 by the lead-out needle 831 to the lead-out passage 701A. The lead-out passage 701A is the passage connected to the ink feed port 611 on the head portion 110 side.

The lead-out passage 701A that extends from the ink feed port 611 branches into two passages, namely, the connection passage 702A and the connection passage 703A, at the branch portion 753A provided in an end portion of the lead-out passage 701A on the head portion 110 side. The connection passages 702A and 703A are respectively connected to the first feed passages 711 and 712, at the connection portions 754A and 755A.

The first feed passages 711 and 712 are respectively connected to the nozzle arrangements 121 and 122 of the head unit 100, and feeds the white ink supplied via the lead-out passage 701A and the connection passages 702A and 703A to the head portion 110 of the head unit 100. The filter portions 681 and 682 are respectively provided in the connection passages 702A and 703A. The filter portions 681 and 682 filter the white ink supplied from the cartridge 311 to the connection passages 702A and 703A via the lead-out passage 701A. In this way, a possibility that foreign matter and gas contained in the white ink inside the cartridge 311 flows into the head portion 110 of the head unit 100 is reduced. Foreign matter contained in the white ink is, for example, a pigment component that has settled. The gas contained in the white ink is, for example, air that has entered by permeating through the tube etc.

A connection portion 756A, which connects the first feed passage 711 and the circulation passage 731, is provided on the outside of the head unit 100, in a position on a downstream side (the head portion 110 side) of the first feed passage 711. Further, a connection portion 757A, which connects the first feed passage 712 and the circulation passage 732, is provided on the outside of the head unit 100 in a position on the downstream side of the first feed passage 712. Respective end portions on the mount portion 80 side of the circulation passages 731 and 732 that extend from the connection portions 756A and 757A are once again connected, respectively, to the first feed passages 711 and 712, at the connection portions 754A and 755A. The circulation passage 731 is provided with the pump 901 and the filter portion 685, and the circulation passage 732 is provided with the pump 902 and the filter portion 686, respectively.

In the first feed passage 711, the connection portion 761A that connects the first feed passage 711 and the discharge passage 761 is provided between the connection portion 756A and the nozzle arrangement 121. Similarly, in the first feed passage 712, the connection portion 762A that connects the first feed passage 712 and the discharge passage 762 is provided between the connection portion 757A and the nozzle arrangement 122. The connection portions 761A and 762A are provided in positions on the upstream side (the mount portion 80 side) of the head portion 110, inside the head unit 100. The discharge passages 761 and 762 extend, respectively, from the connection portions 761A and 762A toward the outside of the head unit 100, without passing through the head portion 110. The discharge ports 761C and 762C are respectively provided on end portions of the discharge passages 761 and 762 on the outer side of the head unit 100.

The first passage 71B will be explained. As shown in FIG. 5, the first passage 71B is provided with the lead-out needle 832, an ink feed port 612, a lead-out passage 701B, connection passages 702B and 703B, a branch portion 753B, connection portions 754B and 755B, first feed passages 713 and 714, circulation passages 733 and 734, connection portions 763A and 764A, discharge passages 763 and 764, discharge ports 763C and 764C, filter portions 683, 684, 687 and 688, and pumps 903 and 904. In the printer 1, the lead-out passage 701B, the connection passages 702B and 703B, the first feed passages 713 and 714, and the circulation passages 733 and 734 are respectively configured from flexible tubes.

The lead-out needle 832 is provided from a rear end inside the lower mount portion 812 toward the front. The ink feed port 612 is provided to the rear of the lower mount portion 812, in the rear surface 82 of the mount frame portion 8. The ink feed port 612 is connected to the lead-out needle 832. The ink feed port 612 feeds the white ink led out from the lower mount portion 812 by the lead-out needle 832 to the lead-out passage 701B. The lead-out passage 701B is the passage connected to the ink feed port 612 on the head portion 110 side.

The lead-out passage 701B that extends from the ink feed port 612 branches into two passages, namely, the connection passage 702B and the connection passage 703B, at the branch portion 753B provided in an end portion of the lead-out passage 701B on the head portion 110 side. The connection passages 702B and 703B are respectively connected to the first feed passages 713 and 714, at the connection portions 754B and 755B.

The first feed passages 713 and 714 are respectively connected to the nozzle arrangements 123 and 124 of the head unit 100, and feed the white ink fed via the lead-out passage 701B and the connection passages 702B and 703B to the head portion 110. The filter portions 683 and 684 are respectively provided in the connection passages 702B and 703B. The filter portions 683 and 684 filter the white ink supplied from the cartridge 312 to the connection passages 702B and 703B via the lead-out passage 701B. In this way, a possibility that foreign matter contained in the white ink inside the cartridge 312 flows into the head portion 110 of the head unit 100 is reduced.

A connection portion 756B, which connects the first feed passage 713 and the circulation passage 733, is provided on the outside of the head unit 100, in a position on the downstream side of the first feed passage 713. Further, a connection portion 757B, which connects the first feed passage 714 and the circulation passage 734, is provided on the outside of the head unit 100 in a position on the downstream side of the first feed passage 714. Respective end portions on the mount portion 80 side of the circulation passages 733 and 734 that extend from the connection portions 756B and 757B are once again connected, respectively, to the first feed passages 713 and 714, at the connection portions 754B and 755B. The circulation passage 733 is provided with the pump 903 and the filter portion 687, and the circulation passage 734 is provided with the pump 904 and the filter portion 688, respectively.

In the first feed passage 713, the connection portion 763A that connects the first feed passage 713 and the discharge passage 763 is provided between the connection portion 756B and the nozzle arrangement 123. Similarly, in the first feed passage 714, the connection portion 764A that connects the first feed passage 714 and the discharge passage 764 is provided between the connection portion 757B and the nozzle arrangement 124. The connection portions 763A and 764A are provided in positions on the upstream side of the head portion 110, inside the head unit 100. The discharge passages 763 and 764 extend, respectively, from the connection portions 763A and 764A toward the outside of the head unit 100, without passing through the head portion 110. The discharge ports 763C and 764C are respectively provided on end portions of the discharge passages 763 and 764 on the outer side of the head unit 100.

In the printer 1, for example, a configuration is assumed in which the four cartridges 3 storing the white ink are mounted in the printer 1 in correspondence to the four nozzle arrangements 121 to 124 of the head portion 110 of the head unit 100. In this configuration, in addition to the upper mount portions 821 to 824 for mounting the cartridges 3 storing the color inks, it is necessary to provide four lower mount portions for mounting the four cartridges 3 storing the white ink. For example, when the four lower mount portions are arrayed such that they are aligned in four rows in the left-right direction, a problem arises in that the printer 1 becomes larger. When the four lower mount portions are arrayed such that they are aligned in two rows in the left-right direction and two rows in the up-down direction, it becomes difficult to secure a positional relationship, in the up-down direction, of each of the plurality of mount portions 80 with respect to the nozzle surfaces 111 of the head units 100 and 200 within a specified range. In this case, water head differences occurring between each of the plurality of cartridges 3 and the nozzle surface 111 are likely to increase. If the water head difference is outside a specified range, it is possible that a meniscus formed on the nozzle surface 111 may burst, causing an ejection failure of the ink 97. As a result, the print quality may deteriorate.

In the present embodiment, in the printer 1, the white ink supplied from the lower mount portions 811 and 812 is caused to branch into the plurality of passages at the branch portions 753A and 753B, namely, into the first feed passages 711 and 712, and the first feed passages 713 and 714. By adopting this type of configuration, the printer 1 can reduce a number of the cartridges 3 storing the white ink that are required to be connected to the printer 1, and succeeds in making the printer 1 smaller. Further, by reducing a number of the mount portions 80, the printer 1 maintains the specified range of the positional relationships in the up-down direction of each of the plurality of mount portions 80 with the nozzle surfaces 111 of the head units 100 and 200, thus allowing the ink 97 to be fed to the nozzle surfaces 111 in a stable manner.

A circulation operation will be explained. The printer 1 performs the circulation operation during a time at which a print operation is not performed when the ink 97 is not ejected from the head portions 110 of the head units 100 and 200. The circulation operation is performed by driving the pumps 901 to 904 and causing a negative pressure in the circulation passages 731 to 734. Before executing printing using the white ink for the first time on a given day, for example, the printer 1 performs the circulation operation. The printer 1 sometimes performs the circulation operation before executing a maintenance operation, such as a purge etc. A timing for executing the circulation of the white ink can be changed, and the white ink may be caused to circulate regularly, such as once an hour, for example. When the circulation operation is performed, as shown by arrows 90 in FIG. 4 and FIG. 5, the white ink circulates inside the first passages 71A and 71B via the circulation passages 731 to 734. In this way, the white ink is stirred in the first passages 71A and 71B. The circulation operation is not performed during the print operation of the printer 1. Thus, during the print operation, the white ink does not circulate in the direction indicated by the arrows 90 inside the circulation passages 731 to 734.

In the present embodiment, the filter portions 681 to 688 are made of a non-woven fabric. A flow resistance occurring in each of the filter portions 681 to 688 provided in the first passages 71A and 71B is larger than a flow resistance in the lead-out needles 831 and 832.

The second passages 721 to 724 will be explained. As shown in FIG. 4 and FIG. 5, the second passages 721 to 724 are the passages that respectively connect the upper mount portions 821 to 824 to the head portion 110 of the head unit 200. The second passages 721 to 724 are respectively provided with the lead-out needles 835, 836, 833, and 834, ink feed ports 621 to 624, second feed passages 741 to 744, connection portions 765A, 766A, 767A, and 768A, discharge passages 765 to 768, and discharge ports 765C, 766C, 767C, and 768C. The second feed passages 741 to 744 are configured by flexible tubes. Note that the second passages 721 to 724 are not provided with a configuration corresponding to the branch portions 753A and 753B, the connection passages 702A, 703A, 702B and 703B, and the circulation passages 731 to 734 of the first passages 71A and 71B. As a result, a configuration corresponding to the filter portions 681 to 688 and the pumps 901 to 904 provided in the connection passages 702A, 703A, 702B, and 703B, and the circulation passages 731 to 734 of the first passages 71A and 71B is also not provided in the second passages 721 to 724.

The lead-out needles 833 to 836 are respectively provided from rear ends inside the upper mount portions 821 to 824 toward the front. The ink feed ports 621 to 624 are respectively provided to the rear of the upper mount portions 821 to 824, in the rear surface 82 of the mount frame portion 8. The ink feed ports 621 to 624 respectively feed the color inks led out from the upper mount portions 821 to 824 by the lead-out needles 833 to 836 to the second feed passages 741 to 744. The second feed passages 741 to 744 are respectively connected to the nozzle arrangements 121 to 124 of the head unit 200, and feed the color inks supplied from the upper mount portions 821 to 824 to the head portion 110 of the head unit 200. The second feed passages 741 to 744 are passages that include subtanks, but the subtanks are not illustrated in FIG. 4 and FIG. 5, in order to simplify the drawings.

The connection portions 765A to 768A are respectively provided in the second feed passages 741 to 744, in positions on the upstream side of the head portion 110, on the inside of the head unit 200. The connection portions 765A to 768A respectively connect the second feed passages 741 to 744 to the discharge passages 765 to 768. The discharge passages 765 to 768 extend, respectively, from the connection portions 765A to 768A toward the outside of the head unit 200, without passing through the head portion 110. The discharge ports 765C to 768C are respectively provided on end portions of the discharge passages 765 to 768 on the outer side of the head unit 200.

As shown in FIG. 4 and FIG. 5, the first passages 71A and 71B and the second passages 721 to 724 can be connected to waste liquid passages 771 to 778, waste liquid open/close valves 781 to 786, pumps 905 and 906, and waste liquid tank 706, via the caps 67 and connection portions 773A and 777A.

The waste liquid passage 771 and the waste liquid passage 772 are respectively connected to the first area 661 and the second area 662 of the cap 67 that can cover the head portion 110 of the head unit 100. The connection portion 773A, which can be connected to the discharge ports 761C to 764C, is provided on an end portion, on the upstream side, of the waste liquid passage 773. The waste liquid passages 771 to 773 converge at a confluence portion 791, and become the single waste liquid passage 774. The waste liquid passage 774 is connected to the waste liquid tank 706. The waste liquid tank 706 is a container to store, on the outside of the ink passage system 700, the ink 97 that has been discharged from the cap 67 and the discharge ports 761C to 764C. The pump 905 is provided in the waste liquid passage 774. The waste liquid passages 771 to 774 can discharge the white ink from the cap 67 and the discharge ports 761C to 764C by suction, due to the drive of the pump 905. The waste liquid open/close valves 781 to 783 are electromagnetic valves respectively provided in the waste liquid passages 771 to 773, and open and close the waste liquid passages 771 to 773 with respect to the waste liquid passage 774. In this way, the pump 905 can be selectively connected to the waste liquid passages 771 to 773.

The waste liquid passage 775 and the waste liquid passage 776 are respectively connected to the first area 661 and the second area 662 of the cap 67 that can cover the head portion 110 of the head unit 200. The connection portion 777A, which can be connected to the discharge ports 765C to 768C, is provided on an end portion, on the upstream side, of the waste liquid passage 777. The waste liquid passages 775 to 777 converge at a confluence portion 792, and become the single waste liquid passage 778. The waste liquid passage 778 is connected to the waste liquid tank 706. The waste liquid tank 706 stores the ink 97 that has been discharged from the cap 67 and the discharge ports 765C to 768C. The pump 906 is provided in the waste liquid passage 778. The waste liquid passages 775 to 778 can discharge the white ink from the cap 67 and the discharge ports 765C to 768C by suction, due to the drive of the pump 906. The waste liquid open/close valves 784 to 786 are electromagnetic valves respectively provided in the waste liquid passages 775 to 777, and open and close the waste liquid passages 775 to 777 with respect to the waste liquid passage 778. In this way, the pump 906 can be selectively connected to the waste liquid passages 775 to 777.

Connection units 401 to 404 will be explained with reference to FIG. 6 to FIG. 10. The connection units 401 to 404 are members that respectively connect the first feed passages 711 to 714 to the head unit 100. Further, connection units 511 to 514 are members that respectively connect the second feed passages 741 to 744 to the head unit 200.

Figure 6:
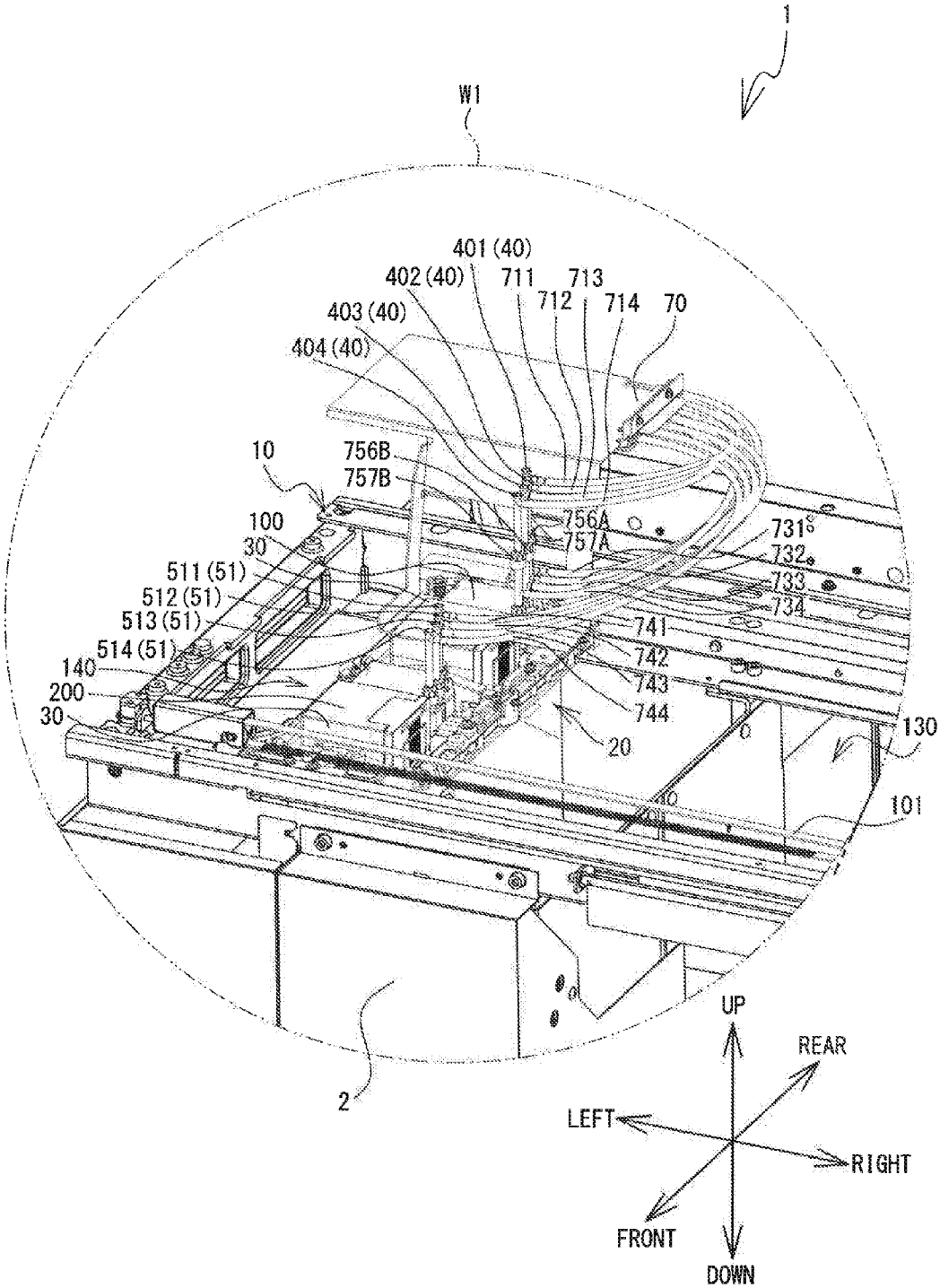
FIG. 6 is a partially enlarged view of FIG. 1.

As shown in FIG. 6, the connection units 401 to 404 are provided arrayed in the front-rear direction on an upper right portion of the housing 30 of the head unit 100. The connection units 401 to 404 have the same shape. Hereinafter, when the connection units 401 to 404 are collectively referred to, or when one of them is not specified, they are referred to as the connection units 40 or the connection unit 40. Similarly to the connection units 40, the connection units 511 to 514 are provided arrayed in the front-rear direction on an upper right portion of the housing 30 of the head unit 200. In the following explanation, when the connection units 511 to 514 are collectively referred to, or when one of them is not specified, they are referred to as the connection units 51 or the connection unit 51. The connection units 40 and 51, the head units 100 and 200, and the various tubes shown in FIG. 6 are a part of the ink passage system 700 that extends from the plurality of mount portions 80. The various tubes that are a part of the ink passage system 700 pass behind the rear side of the housing 2 of the printer 1 and are then guided toward the head units 100 and 200 from above the frame body 10 by a tube guide portion 70.

Figure 7:
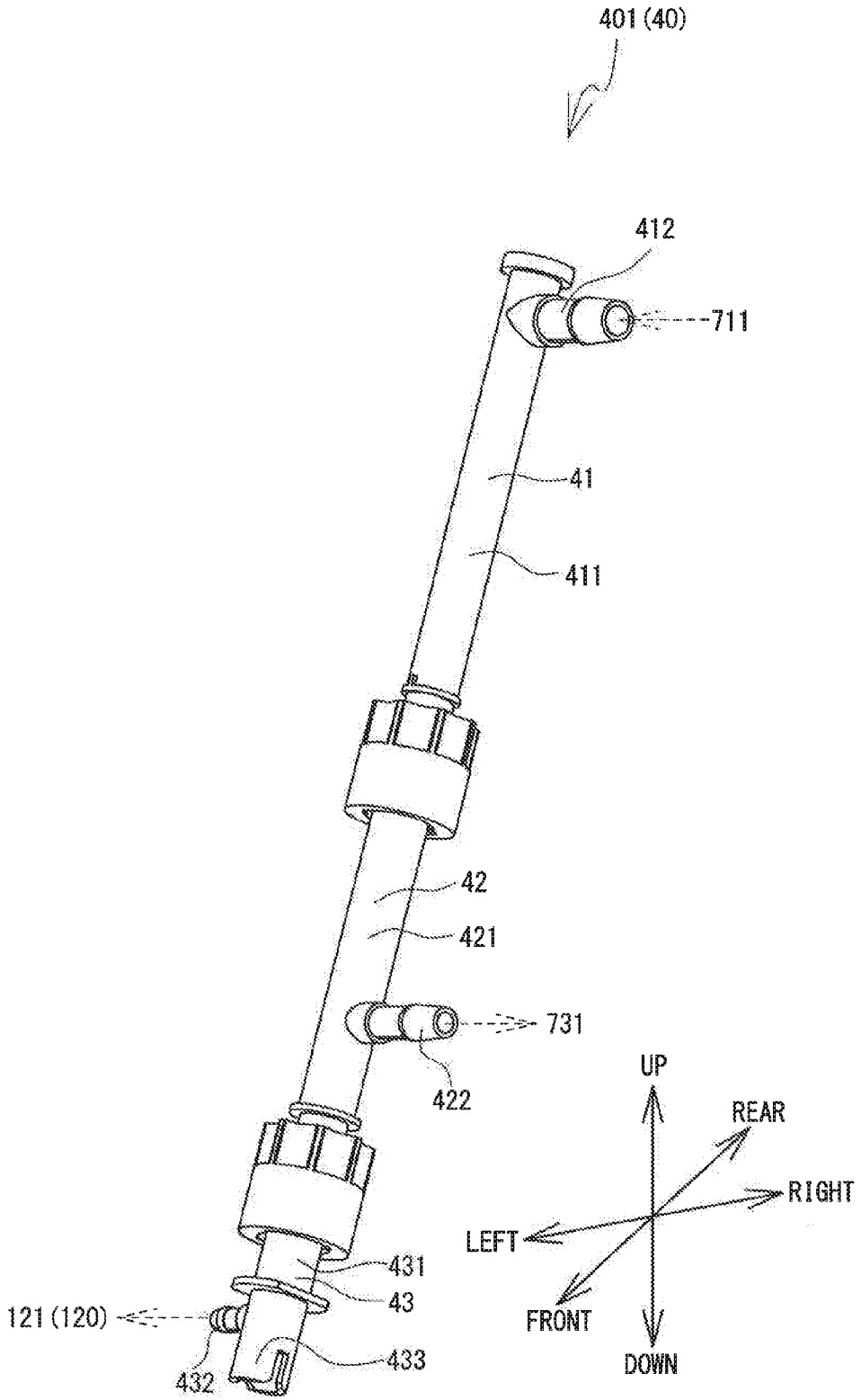
FIG. 7 is a perspective view of a connection unit.

A configuration of the connection unit 40 will be explained, taking the connection unit 401 as an example. As shown in FIG. 7, the connection unit 401 is made of a rigid synthetic resin, and is a cylindrical shape that can internally store the white ink. The connection unit 401 is provided with a first connection portion 41, a second connection portion 42, and a third connection portion 43.

As shown in FIG. 7, the first connection portion 41 is a cylindrical shape that forms an upper portion of the connection unit 401. The first connection portion 41 is provided with a first cylindrical portion 411 and a first connection pipe 412. The first cylindrical portion 411 extends in the up-down direction and is a cylindrical shape whose upper end portion is closed. The first cylindrical portion 411 can store the white ink inside the cylindrical shape. A lower end portion of the first cylindrical portion 411 is open, and communicates with a second cylindrical portion 421 that will be described later. The first connection pipe 412 is a pipe-shaped portion that protrudes to the right from the upper end portion of the first cylindrical portion 411. The first connection pipe 412 connects to the first feed passage 711 at one end on the side that is separated from the first cylindrical portion 411 (refer to FIG. 6). The first connection pipe 412 introduces the white ink supplied via the first feed passage 711 into the inside of the first cylindrical portion 411.

Figure 8:
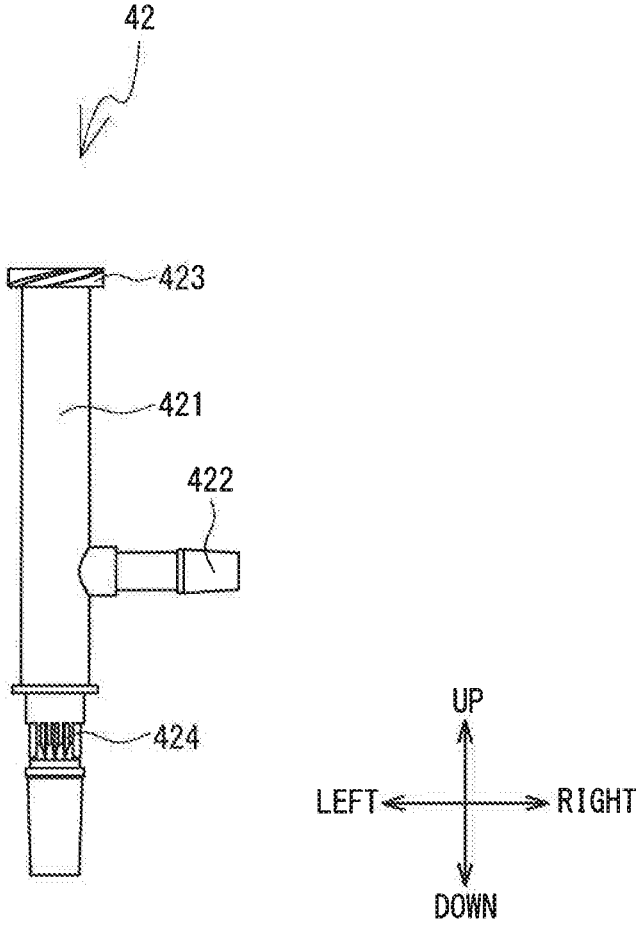
FIG. 8 is a front view of a second connection portion.

As shown in FIG. 7 and FIG. 8, the second connection portion 42 extends downward from the lower end portion of the first connection portion 41, and is a cylindrical shape that forms a center portion, in the up-down direction, of the connection unit 401. The second connection portion 42 is provided with the second cylindrical portion 421, a first attachment portion 423, a second attachment portion 424, and a second connection pipe 422. The second cylindrical portion 421 extends in the up-down direction and is a cylindrical shape whose upper end and lower end are open. The second cylindrical portion 421 can allow the white ink to flow inside the cylindrical shape. The first attachment portion 423 is provided on the upper end portion of the second cylindrical portion 421, and is a portion that is attached to the lower end portion of the first cylindrical portion 411. The second attachment portion 424 is provided on the lower end portion of the second cylindrical portion 421, and is a portion that is attached to a third cylindrical portion 431 to be described later. The interior of the second cylindrical portion 421 communicates with the interiors of the first cylindrical portion 411 and the third cylindrical portion 431. Thus, the second cylindrical portion 421 can feed the white ink introduced from the first cylindrical portion 411 to the third cylindrical portion 431.

The second connection pipe 422 is a pipe-shaped portion that protrudes to the right from substantially a center portion, in the up-down direction, of the second cylindrical portion 421. The second connection pipe 422 connects to the circulation passage 731 at one end on the side that is separated from the second cylindrical portion 421 (refer to FIG. 6). When the circulation operation is performed in the printer 1, the white ink introduced into the connection unit 401 via the first feed passage 711 is led out into the circulation passage 731 via the second connection pipe 422. In this respect, it can also be said that the connection units 401 to 404 respectively configure the connection portions 756A, 757A, 756B, and 757B of the first passages 71A and 71B in the ink passage system 700 (refer to FIG. 4 and FIG. 5).

As shown in FIG. 7, the third connection portion 43 extends downward from the lower end portion of the second connection portion 42 and is a cylindrical shape that forms a lower portion of the connection unit 401. The third connection portion 43 is provided with the third cylindrical portion 431, a third attachment portion 433, and a third connection pipe 432. The third cylindrical portion 431 extends in the up-down direction and is a cylindrical shape whose lower end portion is closed. The third cylindrical portion 431 can store the white ink inside the cylindrical shape. An upper end portion of the third cylindrical portion 431 is open, and communicates with the second cylindrical portion 421. The third connection pipe 432 is a pipe-shaped portion that protrudes toward the left from the lower end portion of the third cylindrical portion 431. The third connection pipe 432 connects to the nozzle arrangement 121, via the first feed passage 711, at one end on the side that is separated from the third cylindrical portion 431 (refer to FIG. 4 and FIG. 5). Therefore, the connection units 401 to 404 can feed the white ink to the nozzle arrangements 121 to 124 after storing, in each of the third cylindrical portions 431, the white ink that has been supplied from the second cylindrical portion 421. The third attachment portion 433 is a projection portion that protrudes downward on the lower end portion of the third cylindrical portion 431. Each of the third attachment portions 433 of the connection units 401 to 404 is inserted into each of recess portions 31 to 34 (refer to FIG. 2) of the housing 30 of the head unit 100, and the connection units 401 to 404 are thus fixed to the housing 30. Ribs that extend in the up-down direction are formed, respectively, on an outer peripheral surface on the lower side of the first cylindrical portion 411 and an outer peripheral surface on the lower side of the second cylindrical portion 421. The rib on the lower side of the first cylindrical portion 411 is a protrusion formed on an inner surface of a connection member that connects the first cylindrical portion 411 and the second cylindrical portion 421, and engages with a protrusion that extends in the up-down direction. Thus, it is difficult for the first cylindrical portion 411 to disengage from the second cylindrical portion 421. The rib on the lower side of the second cylindrical portion 421 is a protrusion formed on an inner surface of a connection member that connects the second cylindrical portion 421 and the third cylindrical portion 431, and engages with a protrusion that extends in the up-down direction. Thus, it is difficult for the second cylindrical portion 421 to disengage from the third cylindrical portion 431.

As shown in FIG. 6, in the printer 1, the connection units 40 having a predetermined length in the up-down direction are arranged in this manner on the upper right portion of the housing 30. In this case, the first feed passage 711 that is connected to the first connection pipe 412 is maintained at a position above the housing 30 by a length from the third attachment portion 433 of the connection unit 40 to the first feed passage 711. When, for example, the length of the connection unit 40 in the up-down direction is shorter than in the present embodiment, a difference in height occurs in the first feed passage 711 between the tube guide portion 70 and the first connection pipe 412 and thus the first feed passage 711 becomes inclined between the tube guide portion 70 and the first connection pipe 412. It becomes easy for gas contained in the ink passage system 700 to accumulate in a specific location, such as a relatively high position etc., in the inclined first feed passage 711. It is sometimes difficult to discharge gas that temporarily accumulates inside the tube from the ink passage system 700, even by performing the circulation operation. If a state is continued in which the gas has accumulated inside the tube, parts of the white ink that come into contact with the gas dry out and become attached, and there is thus a possibility that a concentration gradient may occur in the white ink in the first feed passage 711, or the pigment component of the attached white ink may settle and cause clogging of the first feed passage 711. Further, if the gas accumulated inside the first feed passage 711 all flows at once toward the head portion 110, there is a possibility that an ejection failure may occur in the head portion 110. By holding the first feed passage 711 substantially horizontally at approximately the same height as the tube guide portion 70, the printer 1 maintains favorable fluidity of the ink 97 in the ink passage system 700, and inhibits ejection failure.

Figure 9:
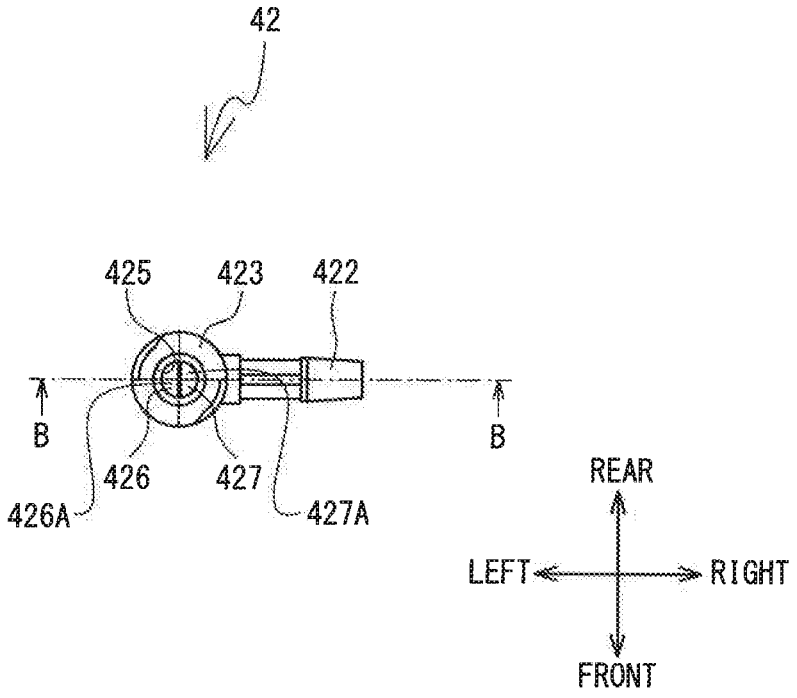
FIG. 9 is a plan view of the second connection portion.
Figure 10:
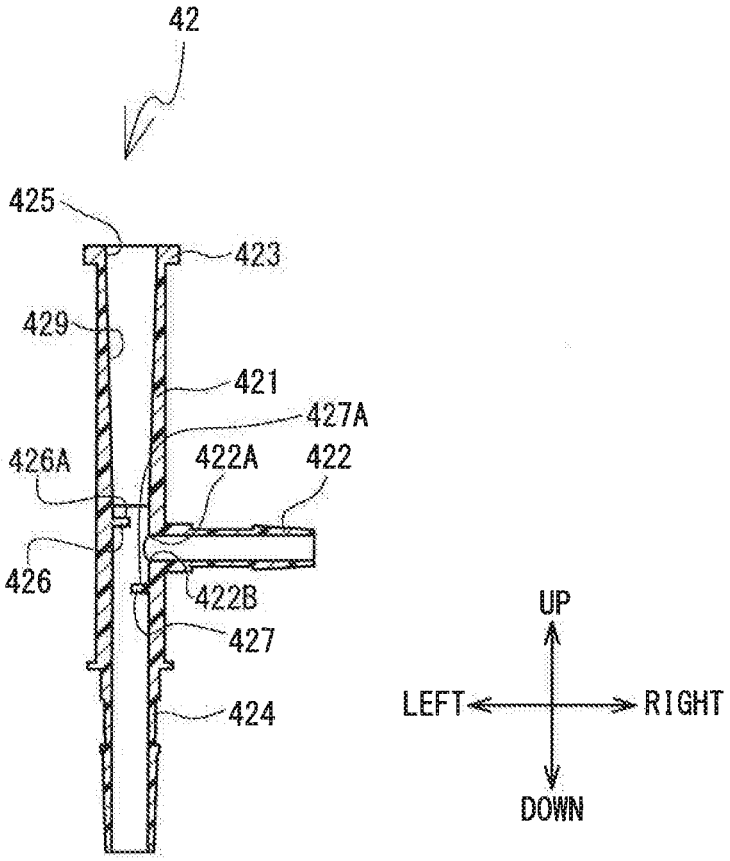
FIG. 10 is a cross-sectional view along B-B shown in FIG. 9.

The configuration of the second connection portion 42 will be explained in detail with reference to FIG. 8 to FIG. 10. As shown in FIG. 9 and FIG. 10, the first attachment portion 423 provided on the upper portion of the second cylindrical portion 421 forms a circular port 425 that is substantially in the center of the first attachment portion 423 in a plan view. The port 425 is connected to an inner wall 429 of the second cylindrical portion 421. As shown in FIG. 10, the second connection pipe 422 that protrudes from the right side of the second cylindrical portion 421 is connected to the inner wall 429 on the inside of the second connection pipe 422. Of the inside of the second connection pipe 422, a location on the upper side that is connected to the inner wall 429 is referred to as an upper connection location 422A. Of the inside of the second connection pipe 422, a location on the lower side that is connected to the inner wall 429 is referred to as a lower connection location 422B.

As shown in FIG. 9 and FIG. 10, a first protrusion portion 426 and a second protrusion portion 427 are provided on the inner wall 429. As shown in FIG. 10, the first protrusion portion 426 is a portion that protrudes to the right from a left portion of the inner wall 429. The second protrusion portion 427 is a portion that protrudes to the left from a right portion of the inner wall 429, in a position that is lower than the first protrusion portion 426. As shown in FIG. 9, an upper surface 426A of the first protrusion portion 426 and an upper surface 427A of the second protrusion portion 427 are both semicircular in a plan view, and both protrude to a center position, in the left-right direction, inside the second cylindrical portion 421.

As shown in FIG. 10, on the inner wall 429, the first protrusion portion 426 is provided in a position above the upper connection location 422A. On the inner wall 429, the second protrusion portion 427 is provided in a position below the lower connection location 422B. In other words, the first protrusion portion 426 and the second protrusion portion 427 are provided in positions on either side of the second connection pipe 422, in the up-down direction. When the white ink flows into the second connection portion 42 via the port 425, there is a possibility that foreign matter may also flow in with the white ink. The above-described foreign matter includes, for example, pigment particles (these pigment particles are a component of the white ink) that settle from above the first protrusion portion 426 with the elapsing of time, in the white ink supplied to the second cylindrical portion 421. In this type of case, it is possible to catch and hold the foreign matter contained in the white ink flowing on the left side inside the second cylindrical portion 421, using the first protrusion portion 426, and to catch and hold the foreign matter contained in the white ink flowing on the right side inside the second cylindrical portion 421, using the second protrusion portion 427. As shown in FIG. 9, a right end edge of the first protrusion portion 426 extends in the front-rear direction and a whole of the right end edge overlaps with the second protrusion portion 427 in the up-down direction. Specifically, when the second cylindrical portion 421 is seen from above, the upper surface 426A and the upper surface 427A protrude in mutually opposing directions so as to completely cover the interior of the second cylindrical portion 421. As a result, the first protrusion portion 426 and the second protrusion portion 427 catch and stop the foreign matter contained in the white ink flowing inside the second cylindrical portion 421, and effectively reduce a possibility of the foreign matter passing through the second attachment portion 424 and flowing into the third cylindrical portion 431.

When the circulation operation is executed, the white ink that has flowed into the second cylindrical portion 421 is discharged to the outside of the second connection portion 42 via the second connection pipe 422. At this time, the foreign matter held by the first protrusion portion 426 and the second protrusion portion 427 is easily discharged to the outside of the second connection portion 42 via the second connection pipe 422 along with the flow of the white ink when the circulation operation is executed. In this manner, the printer 1 limits locations at which the foreign matter inside the connection unit 40 easily settles on the top of the first protrusion portion 426 and the second protrusion portion 427, respectively. Further, by arranging the first protrusion portion 426 and the second protrusion portion 427 in the above-described manner, even assuming a case in which the foreign matter has settled on the first protrusion portion 426 and the second protrusion portion 427, the foreign matter is easily discharged to the outside of the connection unit 40 by the circulation operation.

Similarly to the connection unit 40, the connection unit 51 is a cylindrical shape having a predetermined length in the up-down direction (refer to FIG. 6). The circulation operation is not performed in the second passages 721 to 724 of the ink passage system 700. This is because, since the pigment component used in the color ink has lower settleability than the pigment component of the white ink, in the present embodiment, the circulation operation is not necessary in the second passages 721 to 724. As a result, the connection unit 51 is not provided with a configuration corresponding to the second connection pipe 422, the first protrusion portion 426, and the second protrusion portion 427 of the connection unit 40.

Figure 11:
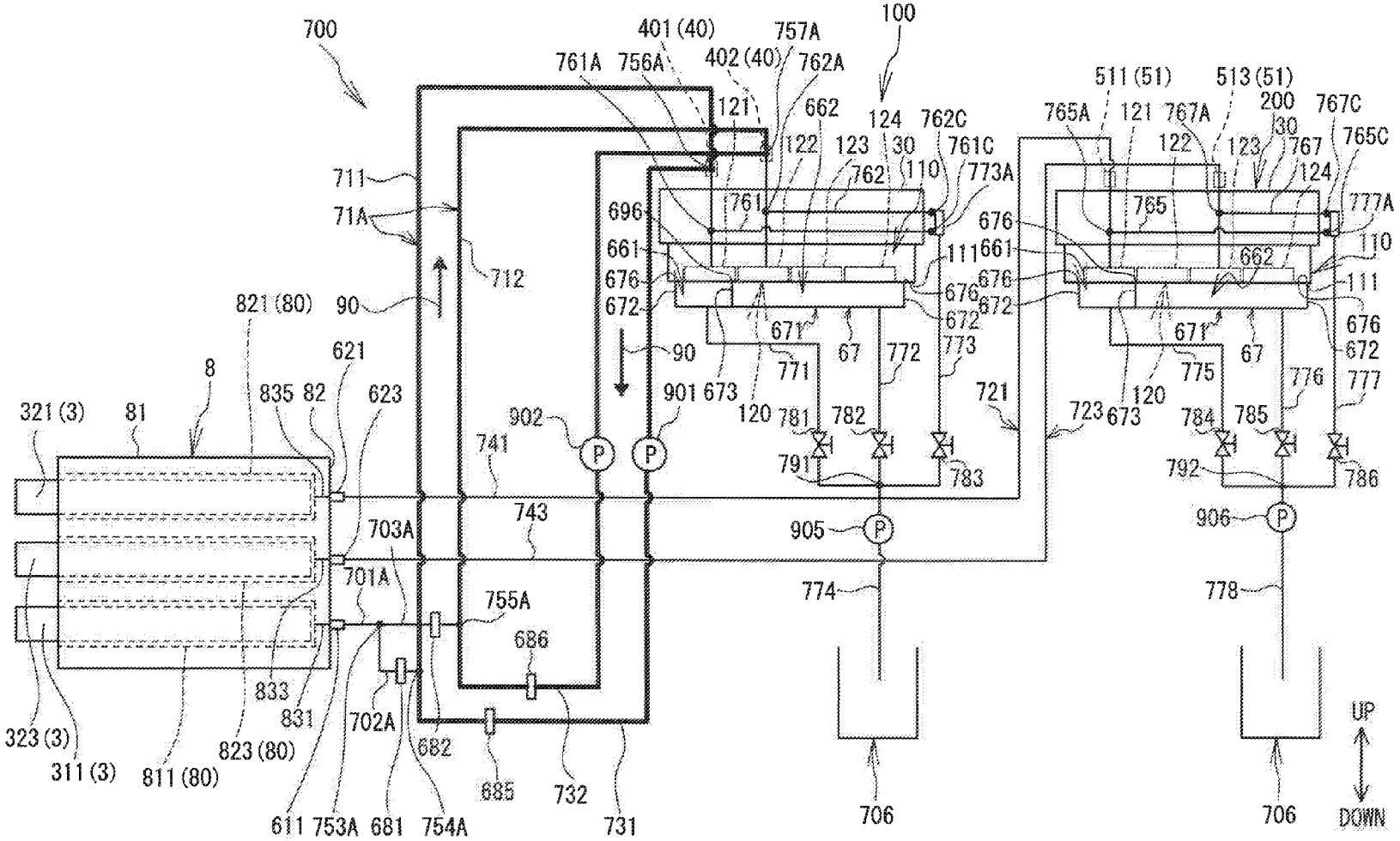
FIG. 11 is a schematic diagram of the ink passage system, showing a state in which a circulation operation is being performed.
Figure 12:
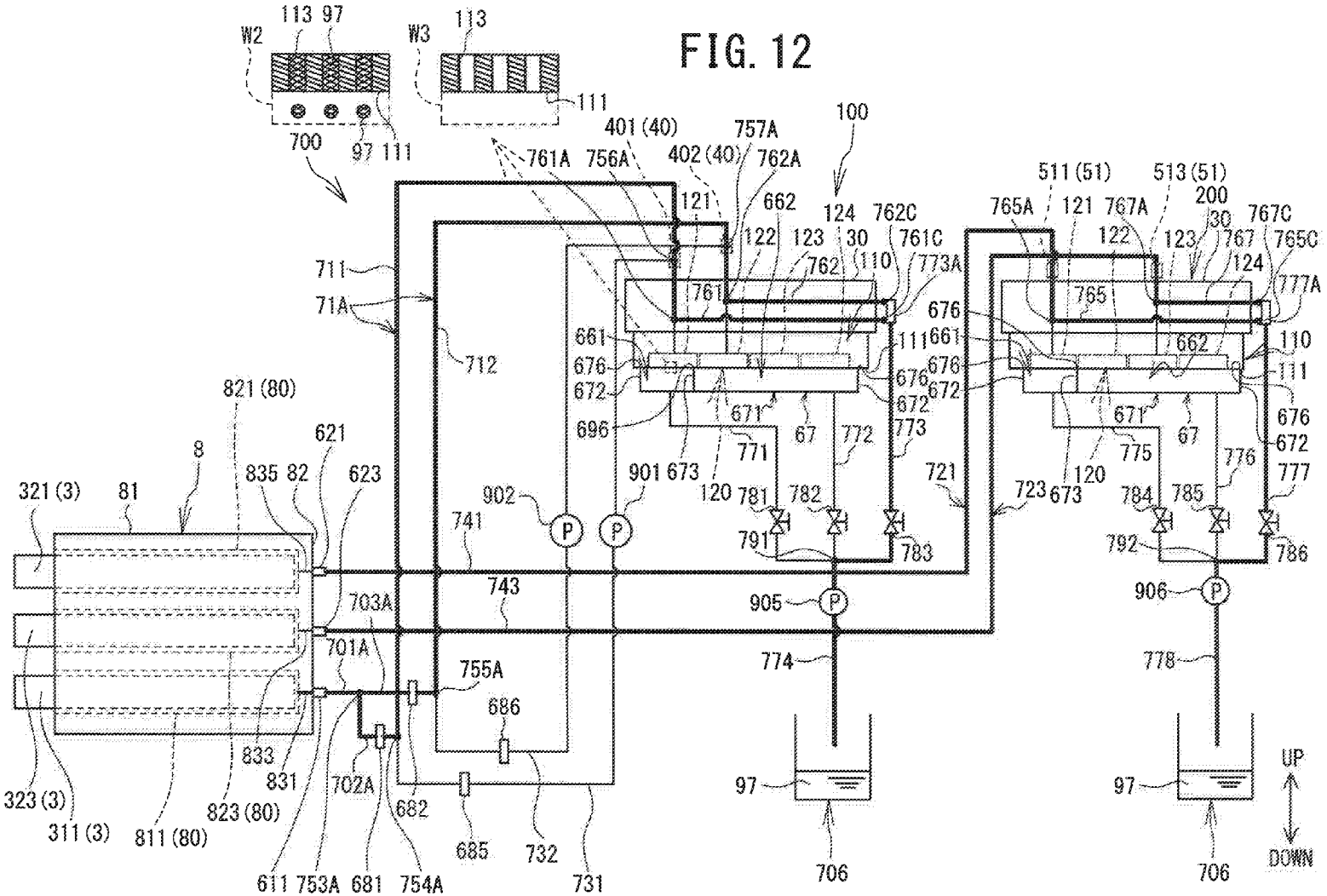
FIG. 12 is a schematic diagram of the ink passage system, showing a state in which an exhaust purge is being performed.
Figure 13:
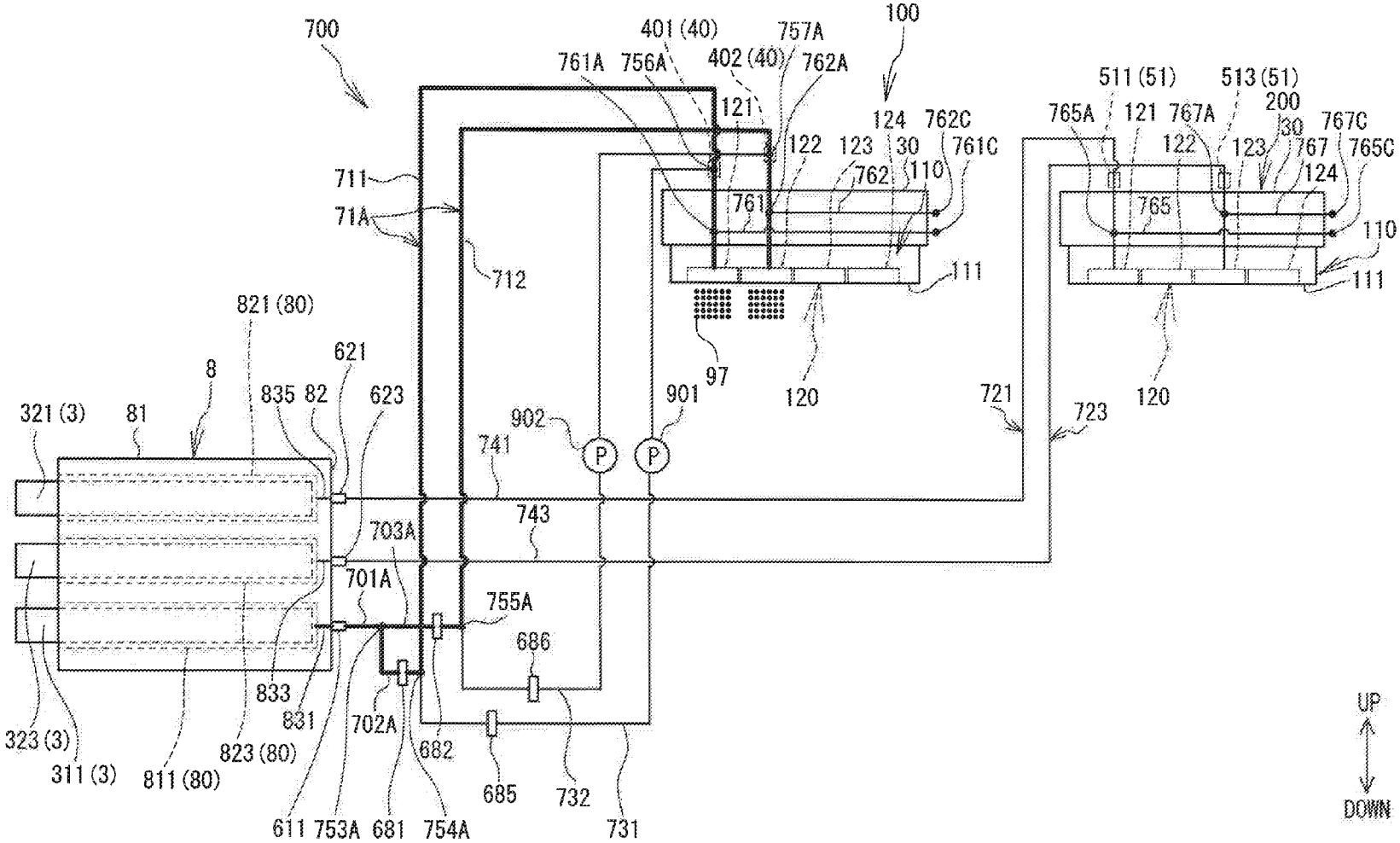
FIG. 13 is a schematic diagram of the ink passage system, showing a state in which a print operation is being performed.

An arrangement of the filter portions 681, 682, 685, and 686 in the first passage 71A of the ink passage system 700 will be explained with reference to FIG. 11 to FIG. 13. The arrangement of the filter portions 683, 684, 687, and 688 in the first passage 71B is the same as the arrangement of the filter portions 681, 682, 685, and 686 in the first passage 71A, and an explanation thereof is therefore omitted. In FIG. 11, passages that are caused to communicate by performing the circulation operation are shown with thicker lines than the other passages. In FIG. 12 and FIG. 13 that will be described later, the passages caused to communicate by performing various operations of the printer 1 are also shown with thicker lines.

As shown in FIG. 11, the circulation operation is performed when the cap 67 is in the cover position. When the circulation operation is performed, the white ink inside the first feed passages 711 and 712 is caused to flow into the circulation passages 731 and 732 via the connection portions 756A and 757A, respectively, as a result of the driving of the pumps 901 and 902. The white ink caused to flow into the circulation passages 731 and 732 once more flows into the first feed passages 711 and 712 at the connection portions 754A and 755A. In this way, the white ink is circulated inside the first passage 71A by flowing in the direction indicated by the arrows 90. At this time, the foreign matter that has accumulated on top of the first protrusion portion 426 and the second protrusion portion 427 in each of the connection units 401 and 402 is discharged to the circulation passages 731 and 732 (refer to FIG. 7 and FIG. 10). The filter portions 685 and 686 provided respectively in the circulation passages 731 and 732 filter the white ink flowing in the circulation passages 731 and 732, and can thus eliminate foreign matter and gas contained in the white ink circulating inside the first passages 71A and 71B.

In the circulation operation, there is a possibility that the foreign matter or the gas contained in the white ink may flow inside the first feed passages 711 and 712, and the circulation passages 731 and 732. In the first passage 71A, the filter portions 681 and 682 are respectively provided in the connection passages 702A and 703A that are further on the upstream side than the connection portions 754A and 755A. Due to the flow resistance in the filter portions 681 and 682, it is possible to reduce a possibility that the white ink containing the foreign matter or the gas may flow back toward the lead-out passage 701A from the side of the first feed passages 711 and 712 and the circulation passages 731 and 732. Further, due to the flow resistance of the filter portions 681 and 682, it is possible to inhibit the white ink from flowing to the side of the mount portion 80 via the connection passages 702A and 703A, and the lead-out passage 701A. In this manner, the printer 1 can inhibit the foreign matter and the gas contained in the white ink circulating inside the first passage 71A from flowing to the side of the mount portion 80 and becoming contained in the cartridge 311.

As shown in FIG. 12, the exhaust purge is performed when the cap 67 is in the cover position. When the exhaust purge is performed, gas contained in the ink passage system 700 is discharged to the outside of the ink passage system 700 from the discharge ports 761C and 762C, along with the ink 97 inside the ink passage system 700, without passing through the head portion 110. The exhaust purge is also performed when the cartridges 3 are mounted in the mount portion 80, and the ink inside the cartridges 3 is introduced into the ink passage system 700 for the first time. In the exhaust purge, the printer 1 opens the waste liquid opening/closing valve 783 while closing the waste liquid open/close valves 781 and 782, in a state in which the connection portion 773A is connected to the discharge ports 761C and 762C. By driving the pump 905 in this state, the printer 1 causes a negative pressure to act on the discharge passages 761 and 762, and the first feed passages 711 and 712, and discharges the white ink inside the first passage 71A to the waste liquid tank 706 via the waste liquid passages 773 and 774. In the state in which the cap 67 is in the cover position, the printer 1 opens the waste liquid open/close valves 781 and 782 and closes the waste liquid opening/closing valve 783, and drives the pump 905, thus generating a negative pressure in the first area 661 and the second area 662 of the cap 67. The printer 1 can thus execute the suction purge.

In the circulation operation, the foreign matter and the gas contained in the white ink circulating inside the circulation passages 731 and 732 attaches to the filter portions 685 and 686. In particular, when gas that has formed a bubble attaches to the filter portions 685 and 686, the flow resistance in the filter portions 685 and 686 becomes higher than before the attachment of the bubble to the filter portions 685 and 686. Here, it is assumed that the filter portions 685 and 686 are provided in the first feed passages 711 and 712. Further, in this assumption, the exhaust purge is performed in a state in which the flow resistance in the filter portions 685 and 686 is higher than a flow resistance when the white ink is sucked toward the connection portions 761A and 762A from the nozzles 113 of the nozzle arrangements 121 and 122. In this case, the white ink inside the nozzles 113 of the nozzle arrangements 121 and 122 (refer to an enlarged view W2) is more easily discharged toward the discharge ports 761C and 762C than the white ink further to the upstream side than the connection portions 761A and 762A in the first feed passages 711 and 712. When the white ink inside the nozzles 113 is sucked out from the head portion 110 and discharged (refer to an enlarged view W3), air from the nozzles 113 is included, and it is possible that an ejection failure of the white ink may occur during the print operation, and the print quality may deteriorate.

In order to inhibit this type of deterioration in the print quality, in the printer 1, the filter portions 685 and 686 are not provided in the first feed passages 711 and 712 and are provided in the circulation passages 731 and 732. By devising the arrangement of the filter portions 685 and 686 in this manner, even when the flow resistance in the filter portions 685 and 686 increases, the printer 1 can inhibit the white ink inside the nozzles 113 from being sucked out of the head portion 110 during the exhaust purge.

The print operation shown in FIG. 13 is performed when the head units 100 and 200 are in the print area 130 (refer to FIG. 2). Thus, in FIG. 13, the cap 67 and the passages connected to the cap 67 etc., which are provided in the non-print area 140, are not illustrated.

Some part of the ink passage system 700 including the first feed passages 711 and 712 are configured by tubes. Minute individual differences are present for each of the tubes, such as an inner diameter and a length of the tube. As a result, sometimes slight differences occur in the flow resistance in each of the first feed passages 711 and 712. Here it is assumed that the filter portions 681 and 682 are not provided in the connection passages 702A and 703A, and instead, a configuration is posited in which a single filter portion is provided on the upstream side of the branch portion 753A in the lead-out passage 701A. In this configuration, when the print operation is performed, the white ink is supplied to the first feed passages 711 and 712 via the branch portion 753A. At this time, if a slight difference has occurred between the flow resistance in each of the first feed passages 711 and 712, the white ink that is supplied via the branch portion 753A flows more easily into the passage that has the lower flow resistance, of the first feed passages 711 and 712. In this case, the white ink in the passage that has the higher flow resistance, of the first feed passages 711 and 712, may be sucked toward and flow into the passage having the lower resistance, via the branch portion 753A. If a flow amount of the white ink is different between the first feed passages 711 and 712, differences occur in an amount of the white ink supplied to each of the nozzle arrangements 121 and 122, and there is a possibility that an ejection failure of the white ink may occur in a given nozzle arrangement.

In order to reduce the possibility of a print failure occurring due to this type of ejection failure of the white ink in the head portion 110, in the printer 1, the filter portion is not provided in the lead-out passage 701A and the filter portions 681 and 682 are provided in the connection passages 702A and 703A, respectively. The filter portions 681 and 682 can reduce a backward flow of the white ink in the first feed passages 711 and 712, as a result of the flow resistance generated in the filter portions 681 and 682. Thus, a possibility is reduced that the white ink supplied to the first feed passages 711 and 712 flows back and forth between the first feed passages 711 and 712 via the branch portion 753A. By devising the arrangement of the filter portions 681 and 682 in this manner, the printer 1 inhibits a feed failure of the white ink to the given nozzle arrangement of the head portion 110 from occurring during the print operation, and thus reduces the possibility of a print failure occurring.

As described above, in the printer 1, the white ink inside the cartridges 311 and 312 that is led out by the lead-out needles 831 and 832 of the lower mount portions 811 and 812, is caused to branch, respectively, into the connection passages 702A and 703A, and the connection passages 702B and 703B at the branch portions 753A and 753B, and is supplied to the first feed passages 711 to 714. For example, when a filter portion is provided in the lead-out passage 701A, the white ink may be sucked out from one toward the other of the first feed passages 711 and 712 via the branch portion 753A, and a feed failure may therefore occur in the other of the first feed passages 711 and 712. In the printer 1, the filter portions 681 to 684 are respectively provided in the connection passages 702A, 703A, 702B and 703B. The flow resistance occurring in the filter portions 681 to 684 is larger than the flow resistance in the lead-out needles 831 and 832. Thus, the possibility is reduced that the white ink may flow back and forth between the first feed passages 711 and 712, and the first feed passages 713 and 714 via the branch portions 753A and 753B. As a result, the printer 1 can inhibit the feed failure of the white ink occurring in each of the first feed passages 711 to 714, and can reduce a deterioration in the print quality.

In the printer 1, the discharge passages 761 to 764 are respectively connected to the first feed passages 711 to 714 without passing through the head portion 110. By applying the negative pressure to the first feed passages 711 to 714 using the pump 905 connected to the discharge ports 761C to 764C, the printer 1 can discharge the fluid inside the first feed passages 711 to 714 from the discharge ports 761C to 764C to the waste liquid tank 706. If, for example, the filter portions 685 to 688 are provided in the first feed passages 711 to 714, when the exhaust purge is executed, the negative pressure applied to the first feed passages 711 to 714 by the pump 905 causes the white ink to be sucked out from the nozzles 113 of the head portion 110 toward the discharge ports 761C to 764C (refer to the enlarged view W3, FIG. 12), and there is a possibility that a print failure may occur. In the printer 1, as well as providing the filter portions 685 to 688 in the circulation passages 731 to 734, the white ink inside the first feed passages 711 to 714 is discharged from the discharge ports 761C to 764C in the state in which the head portion 110 is covered by the cap 67. Therefore, when the printer 1 discharges the white ink from the discharge ports 761C to 764C, it is possible to inhibit the white ink from being sucked out from the nozzle arrangement area 120 of the head portion 110.

The white ink is used mainly as a base coat when performing printing of a color image. Therefore, more white ink than color ink is sometimes used during the print operation. When the mount portions 80 are individually provided for each of the nozzle arrangements 121 to 124 of the head unit 100 in order to connect the cartridges 3 storing the white ink, it is sometimes difficult to secure space to arrange the mount portions 80 while maintaining the water heads of the cartridges 3. Therefore, in the printer 1, the white ink that is led out from the cartridges 311 and 312 is caused to branch into the first feed passages 711 and 712, and the first feed passages 713 and 714, respectively, via the branch portions 753A and 753B. The printer 1 is provided with the filter portions 681 to 684 in the connection passages 702A, 703A, 702B and 703B, and can thus inhibit the white ink from flowing back and forth between the first feed passages 711 and 712, and between the first feed passages 713 and 714, via the branch portions 753A and 753B. As a result, the printer 1 can inhibit a feed failure of the white ink in the first feed passages 711 to 714 connected to the head unit 100, and can reduce the possibility of a deterioration occurring in the print quality.

The white ink includes the pigment component having the higher settleability than the pigment component of the color inks, and there is thus the possibility that the pigment of the white ink may settle inside the first passages 71A and 71B. The printer 1 is provided with the circulation passages 731 to 734 in the first feed passages 711 to 714, respectively, and it is thus possible to agitate the white ink by circulating it in the first passages 71A and 71B. As a result, the printer 1 can inhibit settling of the pigment of the white ink in the first passages 71A and 71B, and can maintain the print quality by inhibiting any bias in pigment concentration in the white ink in the first feed passages 711 to 714.

Using the filter portions 681 to 684, the printer 1 can remove foreign matter included in the white ink that is led out from the lead-out needles 831 and 832 and supplied to the first passages 71A and 71B. Using the filter portions 685 to 688, the printer 1 can remove foreign matter included in the white ink circulating during the circulation operation. When ink that includes air bubbles passes through the filter portions 681 to 688, the air bubbles attach to the filter portions 681 to 688, and the flow resistance is thus generated in the filter portions 681 to 688. In this case, the flow resistance of each of sections of the first passages 71A and 71B becomes larger and there is a possibility that the feed of the white ink to the head portion 110 may become insufficient. Even in this type of case, the printer 1 can inhibit a feed failure of the white ink to the first feed passages 711 to 714, by devising the arrangement of the filter portions 681 to 688 in the first passages 71A and 71B, in the manner described above.

There are cases in which air bubbles are contained in the ink passage system 700. When it is assumed that height differences occur in the first feed passages 711 to 714, and the first feed passages 711 to 714 are inclined, the air bubbles are likely to accumulate at higher positions in the inclined first feed passages 711 to 714. If the air bubbles are left accumulated in the first feed passages 711 to 714, it is possible that the fluidity of the white ink in the first feed passages 711 to 714 may deteriorate and that parts of the white ink that come into contact with the air bubbles may dry out, resulting in the generation of foreign matter, such as a sediment or the like. Further, if the air bubbles all flow at once through the first feed passages 711 to 714 and reach the head portion 110, an ejection failure of the white ink may occur. In the printer 1, the connection unit 40 is provided with the first cylindrical portion 411, the second cylindrical portion 421, and the third cylindrical portion 431 that extend in the up-down direction. The first connection pipe 412 is provided on the upper end portion of the first cylindrical portion 411, and a predetermined distance is provided between the first connection pipe 412 and the third attachment portion 433 that is the lower end portion of the connection unit 40. Thus, the first feed passages 711 to 714 connected to the first connection pipe 412 do not incline, and the first feed passage 711 is maintained substantially horizontally at approximately the same height as the tube guide portion 70. In this manner, the printer 1 can reduce the accumulation of the air bubbles in the first feed passages 711 to 714. Further, the first protrusion portion 426 and the second protrusion portion 427 are provided on the inner wall 429 of the second cylindrical portion 421. Thus, when the pigment component that has settled in the white ink inside the second cylindrical portion 421 flows in with the white ink, the pigment component can be easily stopped by the upper surfaces 426A and 427A. During the circulation operation, the white ink inside the second cylindrical portion 421 is discharged to the outside of the connection unit 40 via the second connection pipe 422. The first protrusion portion 426 and the second protrusion portion 427 are provided in positions on either side of the second connection pipe 422 in the up-down direction. Thus, the pigment component that has settled on the upper surfaces 426A and 427A is easily discharged to the outside of the connection unit 40 in a state of being agitated inside the white ink, by the flow of the white ink. As a result, the printer 1 can inhibit the bias of the pigment concentration in the white ink in the connection unit 40 and can maintain the print quality.

When the interior of the second cylindrical portion 421 is seen from above, the upper surfaces 426A and 427A protrude in mutually opposing directions so as to completely cover the interior of the second cylindrical portion 421. As a result, even if foreign matter, such as the sediment pigment or the like, is included in the white ink moving inside the second cylindrical portion 421, the foreign matter is easily stopped by one of the upper surfaces 426A and 427A and the printer 1 can thus maintain the print quality.

It should be noted that the present disclosure is not limited to the above-described embodiment and various modifications can be made to the above-described embodiment insofar as they do not depart from the spirit and scope of the present disclosure. For example, in the above-described embodiment, the printer 1 executes the circulation operation for the white ink in the ink passage system 700. The printer 1 may cause the color inks to circulate, by providing a similar configuration to the configuration (the branch portions 753A and 753B, the connection passages 702A, 703A, 702B and 703B, the circulation passages 731 to 734, and the pumps 901 to 904) that causes the white ink to circulate, in the second passages 721 to 724. In this case, a configuration corresponding to the filter portions 681 to 688 may be provided in the second passages 721 to 724. Further, in this case, the connection unit 40 may be provided in place of the connection unit 51 provided in the second feed passages 741 to 744.

In the above-described embodiment, the filter portions 681 to 688 have a role to filter the white ink in the first passages 71A and 71B, and additionally have a role to reduce the possibility of a print failure occurring, by generating the appropriate flow resistance inside the first passages 71A and 71B. With respect to this point, the printer 1 may be provided with a valve or the like that can adjust the flow resistance inside the first passages 71A and 71B, in place of some or all of the filter portions 681 to 688, or in addition to some or all of the filter portions 681 to 688. Further, in the above-described embodiment, the flow resistance occurring in each of the filter portions 681 to 688 is larger than the flow resistance in the lead-out needles 831 and 832, but the filter portions 685 to 688 are not limited to this example. Therefore, the flow resistance occurring in the filter portions 685 to 688 may be equal to the flow resistance in the lead-out needles 831 and 832, or may be smaller than the flow resistance in the lead-out needles 831 and 832.

In the above-described embodiment, the first protrusion portion 426 of the second connection portion 42 protrudes to the right from the left portion of the inner wall 429, in a position above the upper connection location 422A, and the second protrusion portion 427 protrudes to the left from the right portion of the inner wall 429, in a position below the lower connection location 422B. The directions in which each of the first protrusion portion 426 and the second protrusion portion 427 protrude are not limited to this example, and it is sufficient that the first protrusion portion 426 and the second protrusion portion 427 protrude such that they oppose each other in different directions of the inner wall 429, in positions on either side of the second connection pipe 422 in the up-down direction. Further, in the above-described embodiment, when the second cylindrical portion 421 is viewed from above, a right end portion of the upper surface 426A and a left end portion of the upper surface 427A are disposed so as to just touch in a center position inside the second cylindrical portion 421. The end portions of each of the upper surfaces 426A and 427A on the center side of the second cylindrical portion 421 may extend to a position such that the upper surfaces 426A and 427A overlap with each other when the second cylindrical portion 421 is viewed from above.

In the above-described embodiment, the four nozzle arrangements 121 to 124 are provided on the head portion 110, but five or more nozzle arrangements may be provided on the head portion 110. In this case, the first passages 71A and 71B may be provided with a branch portion that causes the white ink supplied from the lower mount portions 811 and 812 to branch into a plurality of first feed passages respectively connected to three or more of the nozzle arrangements.

In the above-described embodiment, the cap 67 is provided in the cover position and the cap separation position with respect to the nozzle surface 111, by the cap support portion 69 moving in the up-down direction. The present disclosure is not limited to this example, and the cap 67 may be provided in the cover position and the cap separation position with respect to the nozzle surface 111, by the head portion 110 moving in the up-down direction with respect to the cap 67.

In the above-described embodiment, the partition wall 673 is provided in the cap 67, and thus, during the maintenance operation, such as the purge or the like, the printer 1 inhibits the black ink from attaching to the nozzle arrangements 122 to 124 on the nozzle surface 111 and the other color inks becoming mixed. Even if the partition wall 673 is not provided in the cap 67, the effects of the present disclosure are demonstrated. In this case, the waste liquid passages 771 and 772 may be formed as a single passage. Further, a plurality of the partition walls 673 may be provided in the cap 67. In addition, it is sufficient that the waste liquid tank 706 be provided outside the ink passage system 700, and may thus be provided either inside or outside the printer 1.

In the above-described embodiment, depending on the print image and the color of the print medium, the color inks need not necessarily be ejected after the white ink is ejected. The white ink may be ejected in order to print a pattern or the like. On the print medium, there may be an area on which only the white ink is ejected, or an area on which only the color inks are ejected. The liquid ejected from the head units 100 and 200 is not limited to the ink 97, and may be a discharge agent that removes color from a dyed fabric, for example.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a mount portion configured to allow a storage portion to be mounted thereon, the storage portion storing a liquid;

a lead-out needle provided on the mount portion, the lead-out needle being connected to the storage portion in a manner that the liquid can be led out from the storage portion when the storage portion is mounted on the mount portion;

a head provided with ejection areas each being capable of ejecting the liquid;

liquid passages, each of the liquid passages being connected to a corresponding one of the ejection areas and being provided to feed the liquid from the storage portion;

a branch portion provided to cause the liquid led out from the lead-out needle to branch into each of the liquid passages; and first resistance portions, each of the first resistance portions being located between the branch portion and the head, being provided corresponding to one of the liquid passages, and being configured to generate a flow resistance larger than a flow resistance of the liquid in the lead-out needle.

2. The print device according to claim 1, further comprising:

connection passages connecting an upstream end, in a flow direction, of each of the liquid passages to the branch portion, the flow direction being a direction, in each of the liquid passages, from the branch portion toward the ejection area; wherein each of the first resistance portions is mounted in a corresponding one of the connection passages.

3. The print device according to claim 1, further comprising:

circulation passages; wherein a downstream end and an upstream end, in a first flow direction, of each of the circulation passages are connected to a corresponding one of the liquid passages, respectively, at a first connection portion and a second connection portion, the first flow direction being a direction, in each of the circulation passages, from the second connection portion toward the first connection portion, the first connection portion connects an upstream end, in a second flow direction, of each of the liquid passages to the downstream end of each of the circulation passages, and the second connection portion connects a position on a downstream side, in the second flow direction, of each of the liquid passages to the upstream end of each of the circulation passages, the second flow direction being a direction, in each of the liquid passages, from the branch portion toward the ejection area.

4. The print device according to claim 3, further comprising:

a circulation pump provided in each of the circulation passages; wherein the circulation pump is configured to circulate the liquid in the liquid passage and the circulation passage.

5. The print device according to claim 4, further comprising:

discharge passages; wherein each of the discharge passages is connected to a corresponding one of the liquid passages in a position between the second connection portion and the ejection area, and is provided to be capable of discharging the liquid.

6. The print device according to claim 5, further comprising:

a cap provided to be capable of covering the ejection area of the head; and a waste liquid pump selectively connectable to the cap and the discharge passages; wherein the waste liquid pump is configured to apply a negative pressure to the liquid passages via the discharge passages by being connected to the discharge passages, and to apply a negative pressure to the liquid passages via the ejection area by being connected to the cap.

7. The print device according to claim 6, further comprising:

second resistance portions; wherein each of the second resistance portions is configured to generate a flow resistance of the liquid in a corresponding one of the circulation passages.

8. The print device according to claim 1, wherein the head includes a first head provided with ejection areas capable of ejecting a first liquid containing a first pigment, and a second head provided with ejection areas capable of ejecting a second liquid containing a second pigment having a lower settleability than the first pigment, and the branch portion is provided to cause the liquid led out from the lead-out needle to branch into each of the liquid passages connected to the first head.

9. The print device according to claim 3, wherein the head includes a first head provided with the ejection areas capable of ejecting a first liquid containing a first pigment, and a second head provided with the ejection areas capable of ejecting a second liquid containing a second pigment having a lower settleability than the first pigment, and the circulation passages are connected to the liquid passages connected to the first head.

10. The print device according to claim 1, wherein the first resistance portions include filters that filter the liquid.

11. The print device according to claim 7, wherein the second resistance portions include filters that filter the liquid.

12. The print device according to claim 5, further comprising:

a connection unit provided on the second connection portion; wherein the connection unit includes:

a cylindrical portion extending along a first direction and a second direction, the first direction being a direction in which the liquid is to be ejected from the head, and the second direction being a direction opposite to the first direction;

an inlet port connected to the corresponding one of the liquid passages and provided on a section of the cylindrical portion on a second direction side;

a discharge port connected to the circulation passage and provided on a section of the cylindrical portion on a first direction side;

a first protrusion portion protruding in a third direction, at a position on an inner wall of the cylindrical portion further to the first direction than the discharge port, the third direction being a direction orthogonal to the first direction and the second direction; and a second protrusion portion protruding in a fourth direction, at a position on the inner wall of the cylindrical portion further to the second direction than the discharge port, the fourth direction being a direction opposite to the third direction.

13. The print device according to claim 12, wherein an end edge of the first protrusion portion in the third direction is formed to extend in a fifth direction, the fifth direction being a direction orthogonal to the first direction and the third direction, and the whole of the end edge extending in the fifth direction overlaps with the second protrusion portion in the first direction.

* * * * *